US010066446B2

(12) United States Patent
Hughes et al.

(10) Patent No.: US 10,066,446 B2
(45) **Date of Patent: *Sep. 4, 2018**

(54) TAPERED SPLINE CONNECTION FOR DRILL PIPE, CASING, AND TUBING

(71) Applicant: SunStone Technologies, LLC, Oklahoma City, OK (US)

(72) Inventors: William James Hughes, Highlands Ranch, CO (US); Bryan Lane, Houston, TX (US); Gary Marshall Briggs, Houston, TX (US)

(73) Assignee: SUNSTONE TECHNOLOGIES, LLC, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/699,880

(22) Filed: Sep. 8, 2017

(65) Prior Publication Data

US 2017/0370163 A1 Dec. 28, 2017

Related U.S. Application Data

(60) Continuation of application No. 14/069,824, filed on Nov. 1, 2013, now Pat. No. 9,845,645, which is a (Continued)

(51) Int. Cl.
*E21B 17/046* (2006.01)
*E21B 17/042* (2006.01)

(Continued)

(52) U.S. Cl.
CPC ..... *E21B 17/046* (2013.01); *E21B 17/028* (2013.01); *E21B 17/04* (2013.01); *E21B 17/042* (2013.01); *Y10T 137/0447* (2015.04)

(58) Field of Classification Search
CPC .... E21B 17/042; E21B 17/046; E21B 17/028; E21B 17/04

(Continued)

(56) References Cited

U.S. PATENT DOCUMENTS 1,547,759 A 7/1925 Journeay
1,781,091 A 11/1930 Wilson (Continued)

FOREIGN PATENT DOCUMENTS

CA 2729230 1/2016
CN 1458384 11/2003

(Continued)

OTHER PUBLICATIONS

International Search Report for International (PCT) Patent Application No. PCT/IB11/50329 dated Jun. 21, 2011, 4 pages.

(Continued)

*Primary Examiner* — James M Hewitt, II
(74) *Attorney, Agent, or Firm* — Lewis Brisbois Bisgaard & Smith LLP

(57) ABSTRACT

An apparatus comprises a first number of splines located near a first end of a first joint section and a second number of splines located near a second end of a second joint section. The first number of splines extends in an axial direction of the first joint section and spans a circumferential surface of the first joint section. Each of the first number of splines has a base, a tip, and a pair of flanks that extends from the base to the tip and forms an acute angle. Each of the first number of splines are configured to be received between adjacent pairs of splines in the second number of splines as the first end of the first joint section and the second end of the second joint section are joined.

9 Claims, 14 Drawing Sheets

Related U.S. Application Data division of application No. 12/695,569, filed on Jan. 28, 2010.

(51) Int. Cl.
*E21B 17/02* (2006.01)
*E21B 17/04* (2006.01)

(58) Field of Classification Search
USPC ..... 285/913
See application file for complete search history.

(56) References Cited

U.S. PATENT DOCUMENTS

| | | | | |
|---|---|---|---|---|
| 2,000,716 | A | 5/1935 | Polk | |
| 2,089,168 | A | 8/1937 | Brown | |
| 2,296,198 | A | 9/1942 | Boynton | |
| 2,314,897 | A | 3/1943 | Purinton | |
| 2,750,569 | A | 6/1956 | Moon | |
| 3,126,214 | A | 3/1964 | Wong | |
| 3,249,377 | A | 5/1966 | Weasler | |
| 3,463,228 | A | 8/1969 | Hearn | |
| 3,667,784 | A | 6/1972 | Hokanson et al. | |
| 3,689,113 | A | 9/1972 | Blaschke | |
| 3,863,959 | A | 2/1975 | Blaschke | |
| 4,099,745 | A | 7/1978 | Cobbs | |
| 4,240,652 | A | 12/1980 | Wong et al. | |
| 4,375,310 | A | 3/1983 | Robinson et al. | |
| 4,683,944 | A | 8/1987 | Curlett | |
| 4,792,320 | A | 12/1988 | Nickel | |
| 4,862,976 | A | 9/1989 | Meek | |
| 5,048,871 | A | 9/1991 | Pfeiffer et al. | |
| 5,131,692 | A | 7/1992 | Lemons | |
| 5,238,073 | A | 8/1993 | Rear | |
| 5,269,572 | A | 12/1993 | Mefferd | |
| 5,474,334 | A | 12/1995 | Eppink | |
| 5,609,440 | A | 3/1997 | Roche | |
| 5,685,381 | A | 11/1997 | Kloppers et al. | |
| 5,829,797 | A | 11/1998 | Yamamoto et al. | |
| 5,950,744 | A | 9/1999 | Hughes | |
| 6,123,561 | A | 9/2000 | Turner et al. | |
| 6,148,935 | A | 11/2000 | Wentworth et al. | |
| 6,484,801 | B2 | 11/2002 | Brewer et al. | |
| 6,543,554 | B2 | 4/2003 | Smith | |
| 6,547,479 | B2 | 4/2003 | Dowling, Jr. et al. | |
| 6,572,152 | B2 | 6/2003 | Dopf et al. | |
| 6,581,980 | B1 | 6/2003 | DeLange et al. | |
| 6,634,427 | B1 | 10/2003 | Turner et al. | |
| 6,666,274 | B2 | 12/2003 | Hughes | |
| 6,761,574 | B1 | 7/2004 | Song et al. | |
| 7,104,345 | B2 | 9/2006 | Eppink | |
| 7,226,090 | B2 | 6/2007 | Hughes | |
| 7,390,032 | B2 | 6/2008 | Hughes | |
| 7,493,960 | B2 | 2/2009 | Leising et al. | |
| 7,494,159 | B2 | 2/2009 | Sugino et al. | |
| 7,559,583 | B2 | 7/2009 | Stoetzer | |
| 7,581,602 | B2 | 9/2009 | Lorger et al. | |
| 7,762,824 | B2 | 7/2010 | Smith, III | |
| 7,777,644 | B2 | 8/2010 | Madhavan et al. | |
| 7,823,931 | B2 | 11/2010 | Hamamoto et al. | |
| 9,845,645 | B2 * | 12/2017 | Hughes | E21B 17/046 |
| 2003/0213598 | A1 * | 11/2003 | Hughes | E21B 17/003 166/380 |
| 2008/0230218 | A1 | 9/2008 | Hall et al. | |
| 2008/0230277 | A1 | 9/2008 | Hall et al. | |
| 2009/0200798 | A1 | 8/2009 | Hamamoto et al. | |
| 2010/0116509 | A1 | 5/2010 | Robert et al. | |
| 2011/0180273 | A1 | 7/2011 | Hughes et al. | |
| 2012/0012301 | A1 | 1/2012 | Hughes et al. | |

FOREIGN PATENT DOCUMENTS

| | | |
|---|---|---|
| CN | 1527901 | 9/2004 |
| CN | 101705793 | 5/2010 |
| CN | 102900377 | 1/2013 |
| GB | 2233415 | 1/1991 |
| WO | WO 2005/026494 | 3/2005 |
| WO | WO 2009/148921 | 12/2009 |
| WO | WO 2011/092630 | 8/2011 |

OTHER PUBLICATIONS

Written Opinion for International (PCT) Patent Application No. PCT/IB11/50329 dated Jun. 21, 2011, 7 pages.
International Preliminary Report on Patentability for International (PCT) Patent Application No. PCT/IB11/50329 dated Jul. 31, 2012, 8 pages.
International Search Report and Written Opinion for International (PCT) Patent Application No. PCT/IB/53036 dated Dec. 5, 2011, 10 pages.
International Preliminary Report on Patentability for International (PCT) Patent Application No. PCT/IB11/53036 dated Jan. 22, 2013, 8 pages.
Official Action for New Zealand Patent Application No. 601327 dated Apr. 26, 2013, 2 pages.
Official Action for New Zealand Patent Application No. 605385 dated Aug. 16, 2013, 3 pages.
Official Action for U.S. Appl. No. 12/695,569 dated Apr. 20, 2012, 6 pages.
Official Action for U.S. Appl. No. 12/695,569 dated Jun. 20, 2012, 10 pages.
Official Action for U.S. Appl. No. 12/695,569 dated Jan. 10, 2013, 8 pages.
Official Action for U.S. Appl. No. 13/178,446 dated Jul. 30, 2013, 23 pages.
Official Action for U.S. Appl. No. 13/178,446 dated Oct. 17, 2013, 23 pages.
Official Action for U.S. Appl. No. 12/695,569 dated Apr. 18, 2014, 8 pages.
Notice of Allowance for U.S. Appl. No. 13/178,446 dated Apr. 2, 2014, 5 page.
Official Action for Australian Patent Application No. 2011210293 dated May 29, 2014, 4 pages.
Official Action for Canadian Patent Application No. 2,729,230 dated Jul. 17, 2014, 2 pages.
Official Action for U.S. Appl. No. 12/695,569 dated Nov. 4, 2014, 8 pages.
Extended European Search Report for European Patent Application No. EP 11736688.0, dated Feb. 3, 2015, 10 pages.
Official Action (English summary) for Mexican Patent Application No. MX/a/2012/008548, 2014, 2 pages.
Official Action (English translation) for Eurasian Patent Application No. 201290708, 2014, 2 pages.
English Translation of Official Action for Mexico Patent Application No. MX/a/2012/008548, 2015, 4 pages.
"Drill Faster, Farther, Deeper," Aluminum Drill Pipe, Inc., Aug. 2009, 11 pages.
"FarReach Alloy Drill Pipe," Alcoa, Technical Guide Version 2.0, Apr. 2011, 20 pages.
English Translation of Official Action for Eurasian Patent Application No. 201290708, dated Feb. 26, 2015, 2 pages.
English Translation of China Patent Application No. 201180007741.7, dated Aug. 12, 2015, 8 pages.
Extended Search Report for European Patent Application No. 11806376.7, dated May 4, 2016, 9 pages.
Official Action for U.S. Appl. No. 14/636,592, dated Jul. 11, 2016, 10 pages.
English Translation of Official Action for Chinese Patent Application No. 201180007741.7, dated Sep. 5, 2016, 13 pages.

* cited by examiner

TAPERED SPLINE CONNECTION FOR DRILL PIPE, CASING, AND TUBING

This application is a continuation of U.S. patent application Ser. No. 14/069,824, now U.S. Pat. No. 9,845,645, filed Nov. 1, 2013, which is a divisional of abandoned U.S. patent application Ser. No. 12/695,569, filed Jan. 28, 2010, the entire disclosure of which is incorporated by reference herein.

FIELD OF THE INVENTION

The present disclosure generally relates to drill pipe, casing, and tubing used to locate and produce hydrocarbons in a subterranean environment and more specifically to a connection for joining sections of one of drill pipe, casing, and tubing together.

BACKGROUND OF THE INVENTION

Large portions of hydrocarbon location and production activities involve drilling, pumping, and conduit installation beneath the surface of the earth. In addition, drilling, pumping and conduit installation operations may include water location and distribution. Drilling, pumping, and conduit installation operations may include sewage processing and distribution. Drilling and conduit installation operations may support installation of electrical power transmission lines and telecommunication industry transmission lines. Drilling, pumping, and conduit installation activities often use lengths of pipes. These pipes may be joined together in a variety of different manners. When pipes are joined, there are several considerations. For example, lengths of pipes often extend over long distances. Replacing broken connections may be difficult and timely. Also, drilling activities may require torque to be transmitted across numerous different pipes. Thus, a joint may need to be strong enough to transmit certain levels of torque and resist failure.

Additionally, certain industry standards regarding the diameters of pipe sections exist today. For example, standards exist about the diameters of the inside of pipes. These standards may maintain expected results for a capacity for flow through a string of joined pipes. Standards also exist about the outer diameter of pipes. These standards may maintain expectancies of certain pipes to fit within certain clearances. Thus, there may be limits on the sizes and thicknesses of materials used in the joint sections of the pipes.

Currently available solutions include threaded connections between pipe sections. The threads may be tightened together to form a connection between pipes. However, these types of connections may not transfer the same amount of torque while rotating both to the left and to the right. The threads may become unthreaded when the pipes are rotated in a certain direction and separate. Additional available solutions may involve adding teeth to the ends of joint sections using threaded connections. These teeth may be capable of transferring torque between sections of pipe even while the pipes are rotated in different directions. However, these connections using teeth may not produce desired results for strength in a pipe section.

Accordingly, a need exists for a method and apparatus, which takes into account one or more of the issues discussed above as well as possibly other issues.

SUMMARY OF THE INVENTION

According to one embodiment of the present invention, an apparatus comprises a first number of splines located near a first end of a first joint section and a second number of splines located near a second end of a second joint section. The first number of splines extends in an axial direction of the first joint section. The first number of splines spans a circumferential surface of the first joint section. Each of the first number of splines has a base, a tip, and a pair of flanks that extend from the base to the tip. The pair of flanks forms an acute angle. The second number of splines extends in an axial direction of the second joint section. The second number of splines spans a circumferential surface of the second joint section. Each of the second number of splines has a base, a tip, and a pair of flanks that extends from the base to the tip. The pair of flanks forms an acute angle. Each of the first number of splines is configured to be received between adjacent pairs of splines in the second number of splines as the first end of the first joint section and the second end of the second joint section are joined together to form a connection between the first joint section and the second joint section.

In another embodiment of the present invention, a method for joining sections of piping together is present. The method comprises forming a first number of splines near a first end of a first joint section, forming a second number of splines near a second end of a second joint section, and joining the first end of the first joint section and the second end of the second joint section together to form a connection. The first number of splines extends in an axial direction of the first joint section. The first number of splines spans a circumferential surface of the first joint section. Each of the first number of splines has a base, a tip, and a pair of flanks that extends from the base to the tip. The pair of flanks forms an acute angle. The second number of splines extends in an axial direction of the second joint section. The second number of splines spans a circumferential surface of the second joint section. Each of the second number of splines has a base, a tip, and a pair of flanks that extends from the base to the tip. The pair of flanks forms an acute angle. Each of the first number of splines is configured to be received between adjacent pairs of splines in the second number of splines.

In another embodiment of the present invention, an apparatus is present for connecting a number of pipes. The apparatus comprises a first number of splines located near a first end of a first joint section, a second number of splines located near a second end of a second joint section, and a coupling for securing the first joint section and the second joint section together. The first number of splines extends in an axial direction of the first joint section. The first number of splines spans an inner circumferential surface of the first joint section. Each of the first number of splines has a base, a tip, and a pair of flanks that extends from the base to the tip. Each of the first number of splines has a width configured to decrease as the pair of flanks extends from the base to the tip. The second number of splines extends in an axial direction of the second joint section. The second number of splines spans an outer circumferential surface of the second joint section. Each of the second number of splines has a base, a tip, and a pair of flanks that extends from the base to the tip. Each of the first number of splines has a width configured to decrease as the pair of flanks extends from the base to the tip. Each of the first number of splines is configured to be received between adjacent pairs of splines in the second number of splines as the first end of the first joint section and the second end of the second joint section are joined together to form a connection between the first joint section and the second joint section. The pairs of flanks of each of the first number of splines are configured to be wedged between and seated on flanks of adjacent splines of the second number of splines as the connection is formed. The coupling is configured to wedge the first number of splines between adjacent pairs of splines in the second number of splines to a preconfigured force.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present invention when read in conjunction with the accompanying drawings, wherein:

DETAILED DESCRIPTION

Figure 1A:
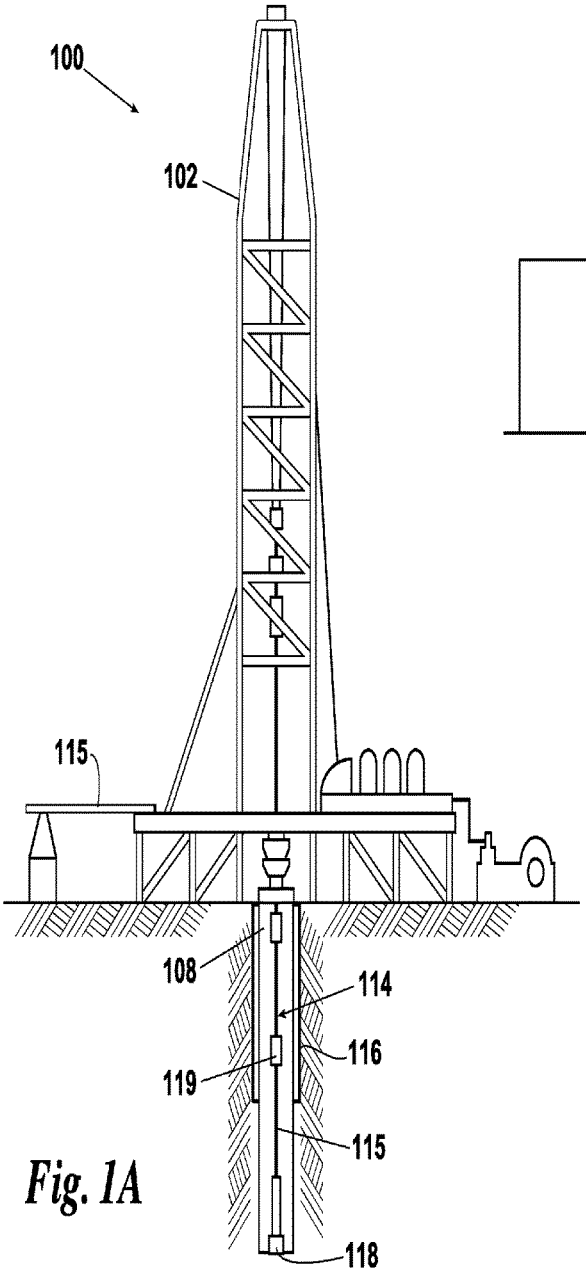
FIG. 1A is an illustration of a hydrocarbon drilling environment in accordance with an illustrative embodiment.

With reference now to the figures and particularly with reference to FIG. 1A, an illustration of a hydrocarbon drilling environment is depicted in accordance with an illustrative embodiment. In this illustrative example, hydrocarbon drilling environment 100 includes drilling derrick 102 and borehole 108. As depicted, derrick 102 includes drill string 114, casing 116, and drill bit 118 to form borehole 108. Drill string 114 may include any number of drill pipes 115 connected end to end using connectors 119. As used herein, a number of items means one or more items.

Figure 1B:
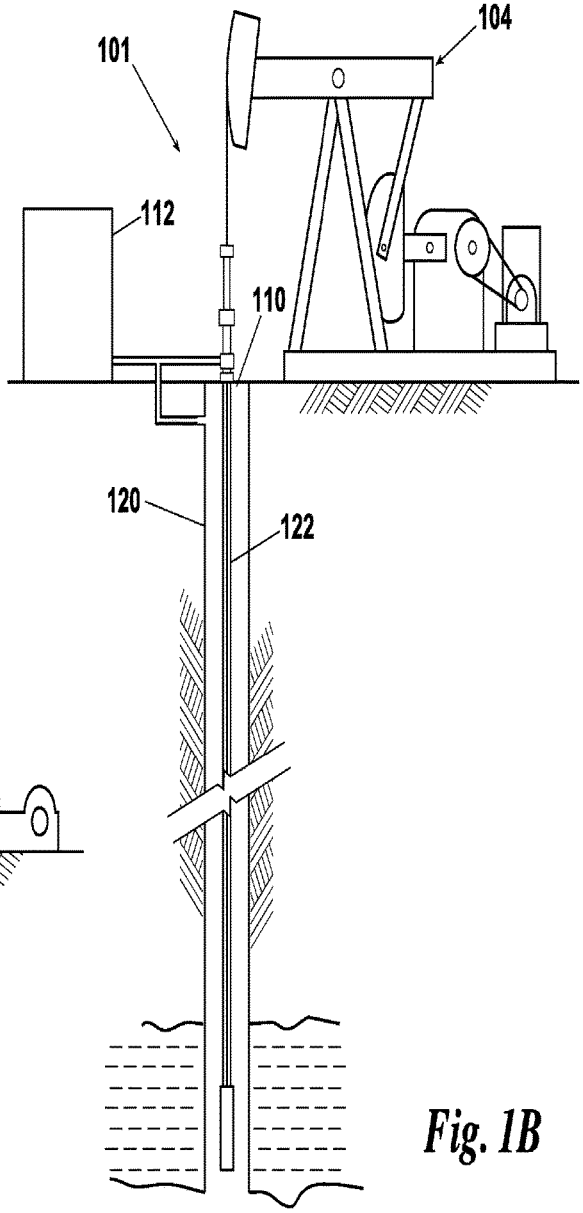
FIG. 1B is an illustration of a hydrocarbon production environment in accordance with an illustrative embodiment.

With reference now to FIG. 1B, an illustration of a hydrocarbon production environment is depicted in accordance with an illustrative embodiment. In this illustrative example, hydrocarbon production environment 101 includes pump jack 104, borehole 111, as well as storage center 112. As depicted, pump jack 104 includes casing 120 as well as tubing 122 to produce hydrocarbons 124, such as oil and gas for example, from borehole 110. Any number of different materials may be used in each of drill pipes 115 in FIG. 1A, casing 120, as well as tubing 122. For example, without limitation, drill pipes 115 in FIG. 1A, casing 120, as well as tubing 122 may be formed from materials selected from one of steel, stainless steel, nickel, copper, aluminum, titanium, concrete, engineered ceramic, fiber reinforced polymer resins, thermoplastic, thermoset polymer including advanced polymers and blends, and/or any other suitable materials and/or any combination thereof.

The different illustrative embodiments recognize and take into account a number of different considerations. For example, the different illustrative embodiments recognize and take into account that it may be desirable to have pipe connections that will resist failure due to the rotational force, such as torque, for example, exerted upon the pipe connections during drilling. The illustrative embodiments recognize that one solution may involve using a shouldered connection. A shouldered connection may involve pipes having threaded ends. The tightening of the threaded ends together causes one pipe end to shoulder or tighten against the other pipe end. However, the illustrative embodiments recognize that the strength of a shouldered connection is a result of the tightening of one shoulder against another shoulder as a result of tightening the threads. Further, when external forces such as torque are exerted upon such a shouldered connection, the threads may yield under the pressure of the external forces.

As used herein "pipe" or "pipes" is/are cylindrical devices that may or may not have a hollow interior. Additionally, the use of the term "pipe" or "pipes" is intended to include without limitation drill pipe, casing, tubing, production tubing, liners, and/or any other cylindrical device suitable for use in wellbores for the production of hydrocarbons. In addition, the use of the term "pipe" or "pipes" is intended to include, without limitation, cylindrical devices for drilling, pumping, and conduit installation operations in support of water location and distribution, sewage processing and distribution, installation of electrical power transmission lines, and installation of telecommunication industry transmission lines. As used herein, "yield", when referring to an object, means for the object to physically deform as a result of applied forces.

The different illustrative embodiments also recognize and take into account that it may be desirable to have a drill pipe that will not become separated while rotating both to the right and to the left. The different illustrative embodiments recognize that one solution may involve a connection using teeth at an end of one pipe section. These teeth at the end of the one pipe section may be joined with teeth at the end of another section such that rotational force is transferred between the pipes while rotating in either direction. However, the illustrative embodiments recognize that the strength of such a connection is a result of the teeth joined together. Further, these teeth are unsupported as they extend from the ends of the pipes. As a result, these teeth may yield when torque is exerted upon the teeth in this connection. As used herein, teeth, when referring to cylindrical objects, are objects that extend from one of the circular ends of the cylindrical object.

Thus, the illustrative embodiments provide a tapered spline connection for drill pipe, casing and tubing. As used herein, splines, when referring to cylindrical objects, are raised surfaces located on a portion of the cylindrical object's outer surface. In one embodiment, an apparatus comprises a first number of splines located near a first end of a first joint section and a second number of splines located near a second end of a second joint section. The first number of splines extends in an axial direction of the first joint section. The first number of splines spans a circumferential surface of the first joint section. Each of the first number of splines has a base, a tip, and a pair of flanks that extend from the base to the tip. The pair of flanks forms an acute angle. The second number of splines extends in an axial direction of the second joint section. The second number of splines spans a circumferential surface of the second joint section. Each of the second number of splines has a base, a tip, and a pair of flanks that extends from the base to the tip. The pair of flanks forms an acute angle. Each of the first number of splines is configured to be received between adjacent pairs of splines in the second number of splines as the first end of the first joint section and the second end of the second joint section are joined together to form a connection between the first joint section and the second joint section.

In another embodiment, the pairs of flanks of each of the first number of splines are wedged between and seated on flanks of adjacent splines of the second number of splines as the first end of the first joint section and the second end of the second joint section are joined together. A coupling is tightened to wedge the first number of splines between adjacent pairs of splines in the second number of splines to a preconfigured force.

In yet another embodiment, tips of each of the first number of splines and each of the second number of splines are configured such that when the connection is formed, a first number of gaps are formed between each tip of the first number of splines and bases of adjacent splines in second number of splines. Additionally, a second number of gaps are formed between each tip of the second number of splines and bases of adjacent splines in first number of splines.

Figure 2:
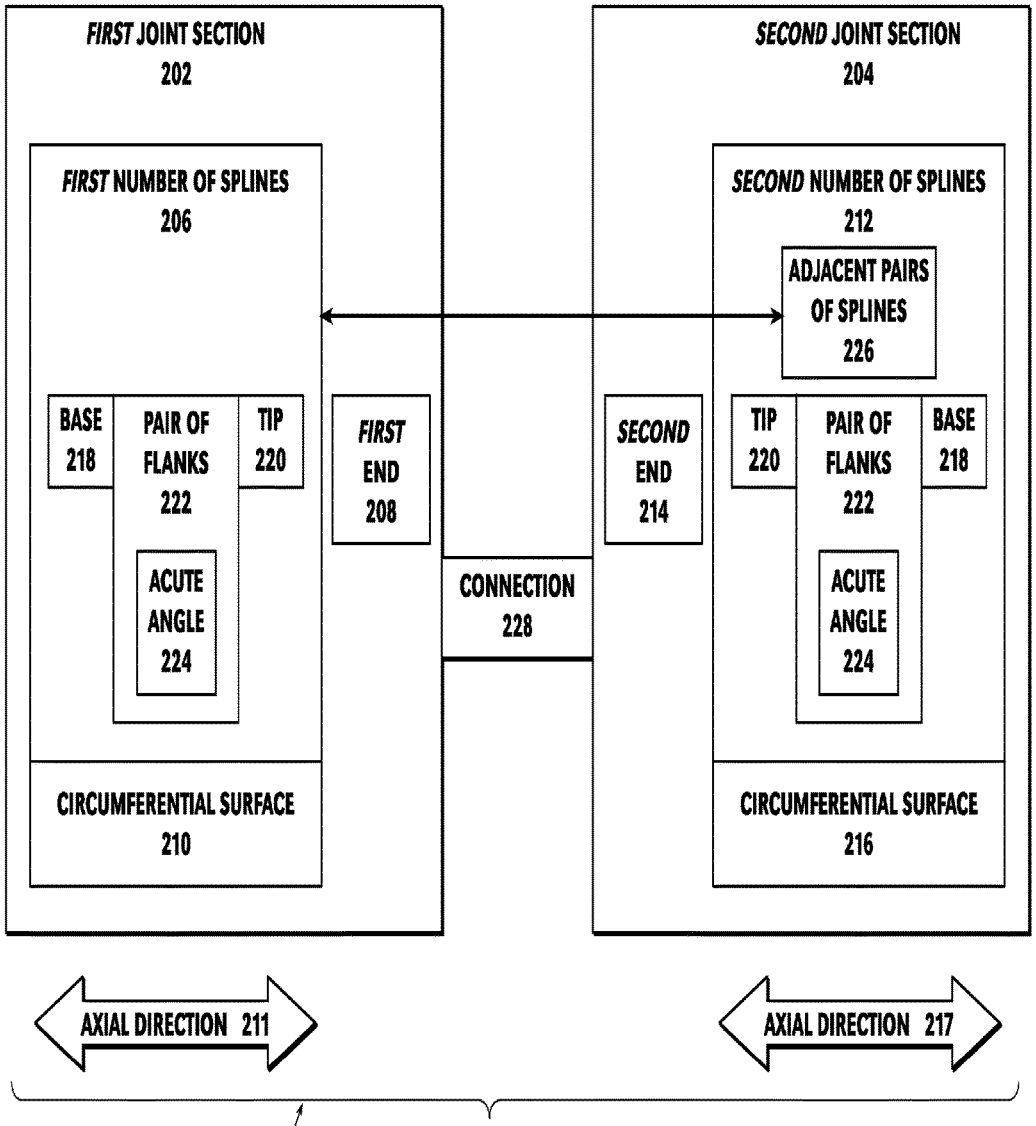
FIG. 2 is an illustration of a block diagram of connection in accordance with an illustrative environment.

With reference now to FIG. 2, an illustration of a block diagram of a connection is depicted in accordance with an illustrative environment. In this illustrative example, connection 200 includes first joint section 202 and second joint section 204. For example, first joint section 202 and/or second joint section may be portions of cylindrical objects, such as for example, without limitation, a drill pipe, tubing, casing, a liner, and/or any other objects suitable for production and/or location of hydrocarbons. Additionally, connection 200 may be implemented in a hydrocarbon drilling environment and/or hydrocarbon production environment, such as hydrocarbon drilling environment 100 in FIG. 1A and hydrocarbon production environment 101 in FIG. 1B. Persons skilled in the art recognize and take note that other environments exist in which connection 200 may be implemented. Such other environments may include, for example, drilling, pumping, and conduit installation environments in which drilling, pumping, and conduit installation operations support water location and distribution, sewage processing and distribution, installation of electrical power transmission lines, and installation of telecommunication industry transmission lines.

As depicted, first joint section 202 includes first number of splines 206 located near first end 208 of first joint section 202. First number of splines 206 span circumferential surface 210 of first joint section 202. First number of splines 206 also extend in axial direction 211 of first joint section 202. Similarly, second joint section 204 includes second number of splines 212 located near second end 214 of second joint section 204. Second number of splines 212 span circumferential surface 216 of second joint section 204. Second number of splines 212 also extend in axial direction 217 of second joint section 204.

As used herein, a circumferential surface, when referring to objects, is a surface of the object that bounds the object in a circular fashion. For example, a circumferential surface may be a surface corresponding to an inner circumference of a cylinder. A circumferential surface may also be a surface corresponding to an outer circumference of a cylinder. Also used herein, an axial direction when referring to cylindrically shaped objects means a direction substantially parallel to the center axis of the cylindrically shaped object.

In this illustrative embodiment, splines in both first joint section 202 and second joint section 204 have a shape defined by base 218, tip 220, and pair of flanks 222 that extends from base 218 to tip 220. Pair of flanks also form acute angle 224. Each spline in first number of splines 206 is configured to be received between adjacent pairs of splines 226 in second number of splines 212 as first end 208 of first joint section 202 and second end 214 of second joint section 204 are joined together to form connection 228 between first joint section 202 and second joint section 204.

The illustration of connection 200 in FIG. 2 is not meant to imply physical or architectural limitations to the manner in which different illustrative embodiments may be implemented. Other components in addition to, and/or in place of, the ones illustrated may be used. Some components may be unnecessary in some illustrative embodiments. Also, the blocks are presented to illustrate some functional components. One or more of these blocks may be combined and/or divided into different blocks when implemented in different illustrative embodiments.

For example, in one illustrative embodiment, first joint section 202 and second joint section 204 may be a tool joint. First joint section 202 and second joint section 204 may be secured to ends of pipes. First joint section 202 and second joint section 204 may also be formed on surfaces of pipes near the end of the pipes. First joint section 202 and second joint section 204 may have different inner diameters and outer diameters. For example, without limitation first joint section 202 and second joint section 204 may be a connection section for pipes having three and a half inch diameters, five inch diameters or any other sizes suitable for use in locating and/or producing hydrocarbons. In other embodiments, splines in first number of splines 206 and second number of splines 212 may be different sizes than each other. Splines in first number of splines 206 and second number of splines 212 may also have different spacing from each other to receive different sizes of splines.

Figure 3:
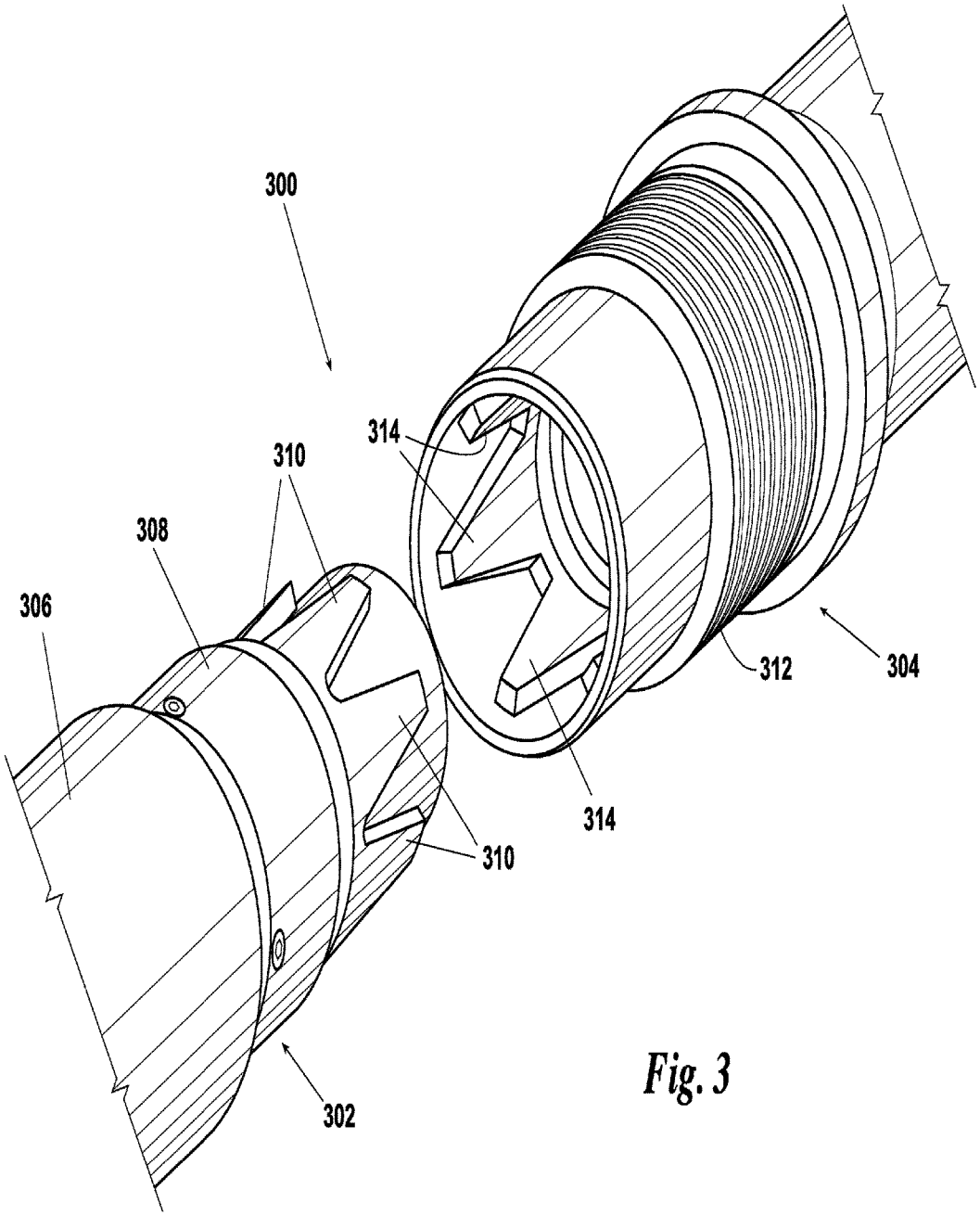
FIG. 3 is an illustration of a connection section for two pipes to be joined together in accordance with an illustrative embodiment.

With reference now to FIG. 3, an illustration of a connection section for two pipes to be joined together is depicted in accordance with an illustrative embodiment. Connection section 300 includes first joint section 302 and second joint section 304. First joint section 302 includes coupling 306, load ring 308, and plurality of splines 310. Coupling 306 is configured to slide over load ring 308. First joint section 302 also has threads on an inner surface of coupling 306 which cannot be seen in this particular illustration. Second pipe joint section 304 includes threads 312 and plurality of splines 314. Threads 312 are configured to receive the threads on the inner surface of coupling 306. In this example, threads 312 are right hand threads, though left hand threads may be used in alternative embodiments.

In this illustrative embodiment, first joint section 302 and second joint section 304 may be a tool joint secured to the end of a pipe. Additionally, first joint section 302 and second joint section 304 may be a section of the actual pipe near an end of the pipe. First joint section 302 and second joint section 304 may be machined or otherwise formed onto the actual pipe. In this example, first joint section 302 is a male connector while second joint section 304 is a female connector. In another example, first joint section 302 could be the female connector while second joint section 304 is the male connector. In other examples, first joint section 302 could be an upper or lower joint section relative to second joint section 304.

Figure 4:
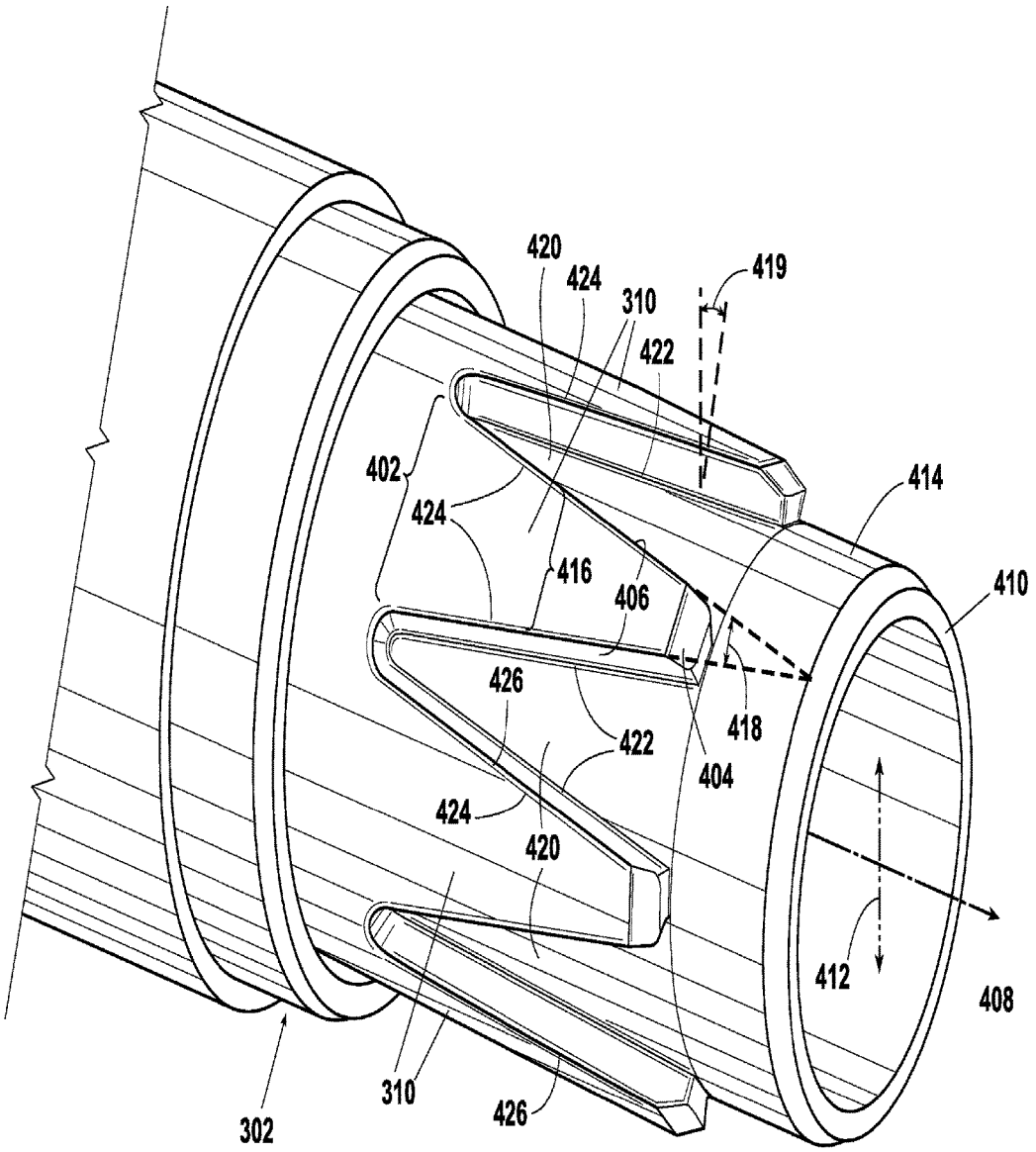
FIG. 4 is an illustration of a detailed view of a joint section on a pipe in accordance with an illustrative embodiment.

With reference now to FIG. 4, an illustration of a detailed view of a joint section on a pipe is depicted in accordance with an illustrative embodiment. In this illustrative example, first joint section 302 and plurality of splines 310 are depicted with greater detail. Each of plurality of splines 310 have base 402, tip 404, and pair of flanks 406. In this example, each of plurality of splines 310 extend from base 402 in axial direction 408 towards end 410 of first joint section 302. Each of plurality of splines 310 also extends outwardly in radial direction 412 from outer surface 414 of first joint section 302. Also as used herein, a "radial direction" or "radial extension," when referring to cylindrically shaped objects means a direction substantially perpendicular to the center axis of the cylindrically shaped object.

Plurality of splines 310 are also tapered, meaning that as plurality of splines extend from base 402 towards tip 404 width 416 of plurality of splines 310 decreases. For example, this decrease in width 416 is attributable to spline flank angle 418. Spline flank angle 418 is the angle between pair of flanks 406. Each flank in pair of flanks 406 form flank face angles 419 as each flank extends in radial direction 412 from outer surface 414. Additionally, the radial extension of plurality of splines 310 from outer surface 414 form recessed areas 420 between each of plurality of splines 310.

In this illustrative embodiment, plurality of splines 310 also includes root radii 422 as well as chamfers 424. Root radii 422 are the small edging portions near the interface between plurality of splines 310 and outer surface 414 of first joint section 302. Chamfers 424 are the rounding off or reduction of edge 426 of plurality of splines 310.

Figure 5:
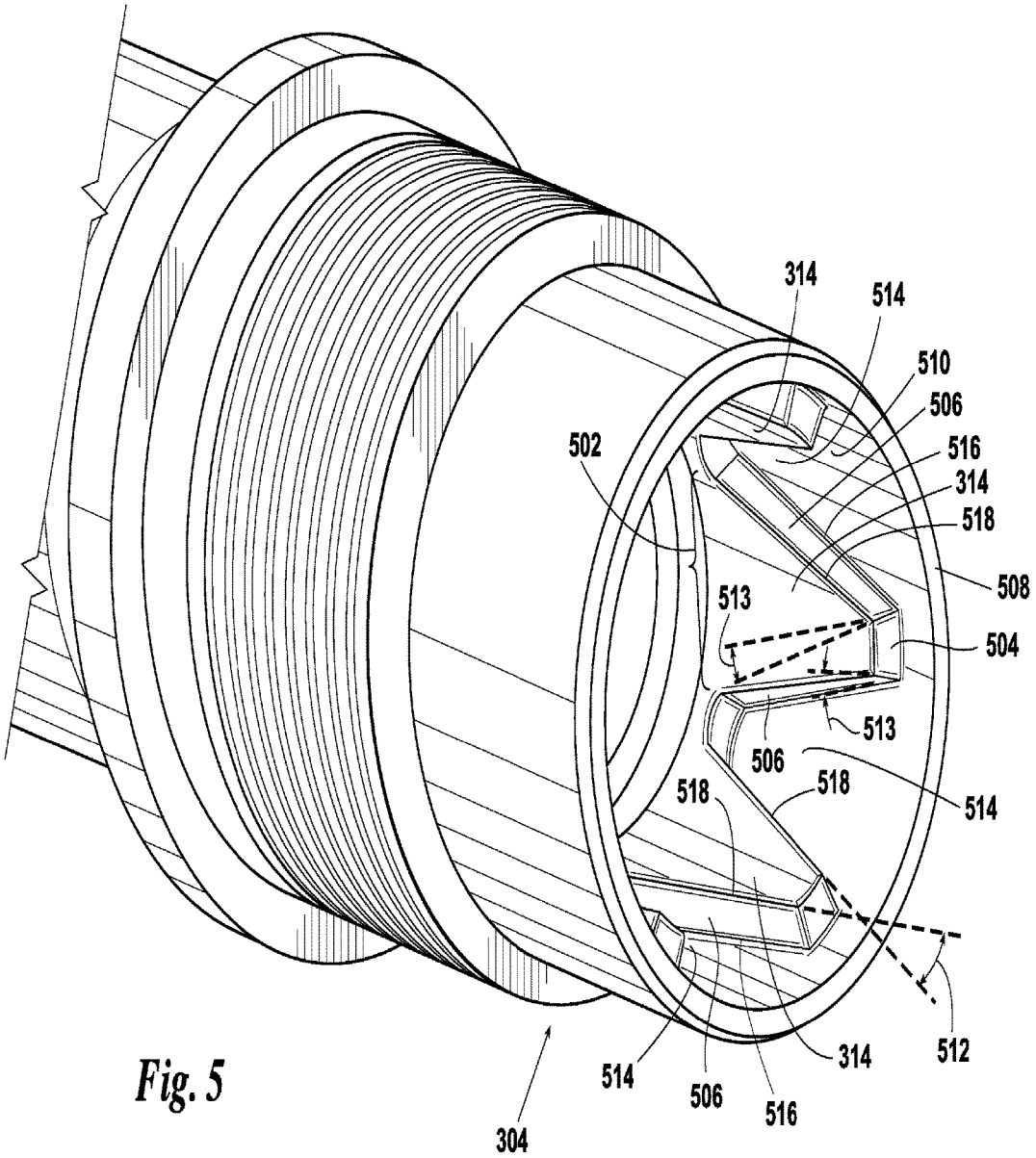
FIG. 5 is an illustration of a detailed view of a joint section on a pipe in accordance with an illustrative embodiment.

With reference now to FIG. 5, an illustration of a detailed view of a joint section on a pipe is depicted in accordance with an illustrative embodiment. In this illustrative example, second joint section 304 and plurality of splines 314 are depicted with greater detail. The shape of plurality of splines 314 is similar to the shape of plurality of splines 310 in that each of plurality of splines 314 also have base 502, tip 504, and pair of flanks 506. Each of plurality of splines 314 extend from base 502 in an axial direction towards end 508 of second joint section 304. However, each of plurality of splines 314 extends inwardly in a radial direction from inner surface 510 of second joint section 304. Like plurality of splines 310, plurality of splines 314 are tapered and have spline flank angle 512 between pair of flanks 506. Each flank in pair of flanks 506 form flank face angles 513 as each flank extends in a radial direction from inner surface 510. Additionally, the radial extension of plurality of splines 314 from inner surface 510 form recessed areas 514 between each of plurality of splines 314.

In this illustrative embodiment, plurality of splines 312 also includes root radii 516 as well as chamfers 518. Root radii 516 and chamfers 518 may be another example of root radii 422 as well as chamfers 424 in FIG. 4. Root radii 516 provide additional support for plurality of splines 314. Chamfers 518 allow splines of opposing joint sections, such as plurality of splines 310 in FIG. 4 for example, to match with and be received between splines in plurality of splines 314. Root radii 516 as well as chamfers 518 may also reduce wear and deformation of the edges of the splines, such as edge 426 of plurality of splines 310 in FIG. 4. Root radii 516 and chamfers 518 may also reduce a tendency for edges of opposing splines to become stuck together during connection and separation stages.

Figure 6:
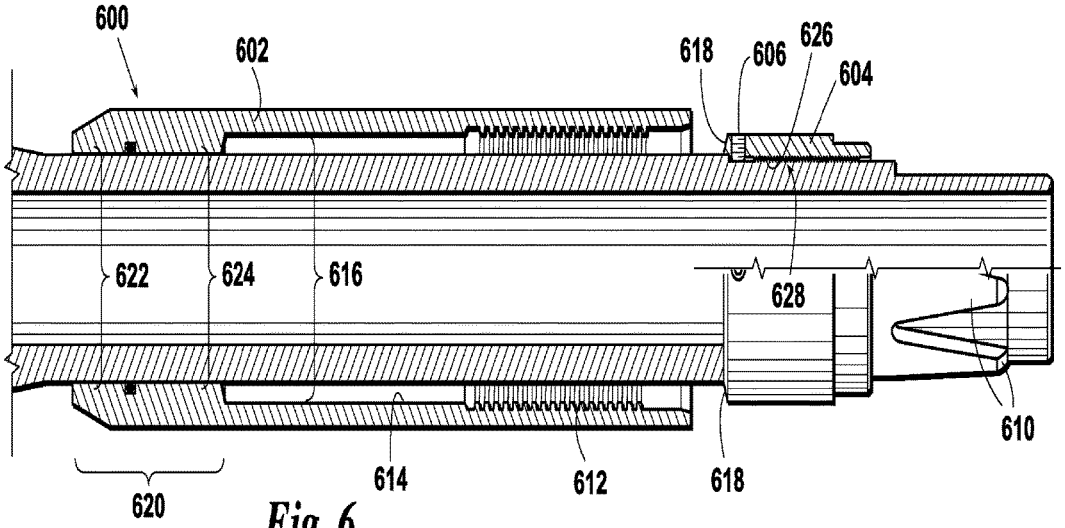
FIG. 6 is an illustration of a cross-sectional view of a joint section on an upper pipe in accordance with an illustrative embodiment.

With reference now to FIG. 6, an illustration of a cross-sectional view of a joint section on an upper pipe is depicted in accordance with an illustrative embodiment. In this illustrative example, upper joint section 600 includes coupling 602, load ring 604, set screws 606, and plurality of splines 610. Upper joint section 600 is an example of one embodiment of first joint section 302 in FIG. 3.

In this illustrative embodiment, coupling 602 has set of threads 612 formed in inner surface 614. Inner surface 614 of coupling 602 has diameter 616 that is substantially equal to outer diameter 618 of load ring 604. This configuration allows inner surface 614 of coupling 602 to slide in the axial direction around load ring 604. On the other hand, portion 620 of coupling 602 has inner diameter 622 that is substantially smaller than diameter 616 of inner surface 614. Inner diameter 622 is also substantially equal to outer diameter 624 of upper joint section 600. Inner diameter 622 being substantially equal to outer diameter 624 of upper joint section 600 allows coupling 602 to slide around load ring 604 until the point where portion 620 of coupling 602 contacts load ring 604.

As depicted, load ring 604 has set of inner threads 626 that are matched to threads 628 located on upper joint section 600. Set of inner threads 626 allow load ring 604 to be rotated onto threads 628 located on upper joint section 600. Once in place, load ring 604 may be secured to upper joint section 600 and secured using set screws 606. Any number of set screws 606 may be used to lock load ring 604 in place. In alternative embodiments, load ring 604 may be formed on upper joint section 600. Thus, load ring 604 and upper joint section 600 may be the same physical part.

Figure 7:
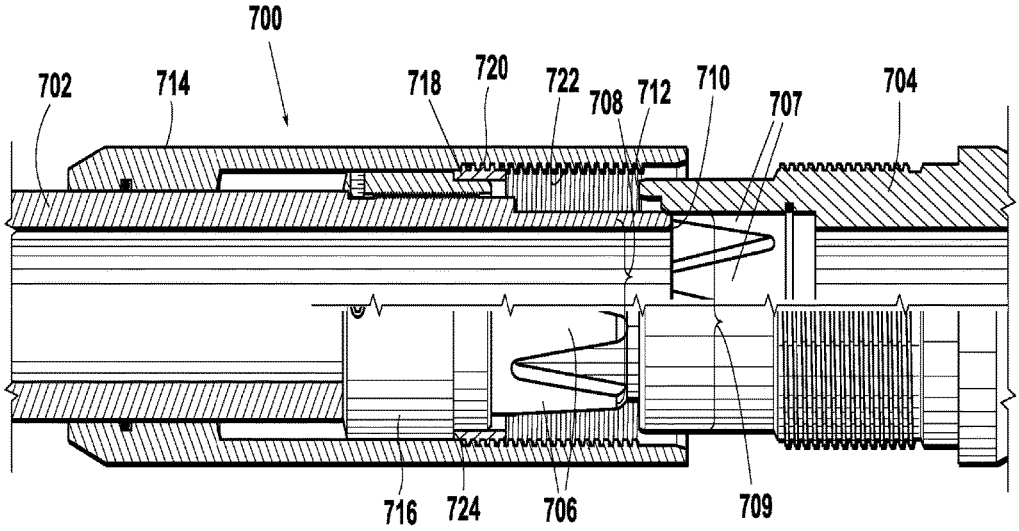
FIG. 7 is an illustration of a side cross-sectional view of a pair of joint sections at an initial engagement stage in accordance with an illustrative embodiment.

Turning now to FIG. 7, an illustration of a side cross-sectional view of a pair of joint sections at an initial engagement stage is depicted in accordance with an illustrative embodiment. In this illustrative example, connection section 700 includes upper joint section 702 and lower joint section 704. Connection section 700 is an example of one embodiment of connection section 300 in FIG. 3, while upper joint section 702 and lower joint section 704 may be examples of first joint section 302 and second joint section 304 in FIG. 3, respectively.

As depicted, upper joint section 702 includes plurality of splines 706 on an outer surface. Similarly, lower joint section 704 includes plurality of splines 707 on an inner surface. In this example, outer diameter 708 of upper joint section 702 is less than inner diameter 709 of lower joint section 704. Outer diameter 708 of upper joint section 702 being less than inner diameter 709 of lower joint section 704 allows end 710 of upper joint section 702 to be placed inside end 712 of lower joint section 704. Outer diameter 708 of upper joint section 702 being less than inner diameter 709 of lower joint section 704 also allows plurality of splines 706 to be received and positioned in recesses between plurality of splines 707. Connection section 700 further includes coupling 714, load ring 716, and retaining ring 718.

In this illustrative embodiment, retaining ring 718 restricts coupling 714 from sliding in an axial direction away from lower joint section 704. Retaining ring 718 is positioned in coupling 714 by engaging threads 720 of retainer ring 718 with threads 722 of coupling 714 when coupling 714 is slid over load ring 716. Once engaged, retaining ring 718 then contacts shoulder 724 of load ring 716 to restrict coupling 714 from sliding away from load ring 716 and lower joint section 704.

Figure 8:
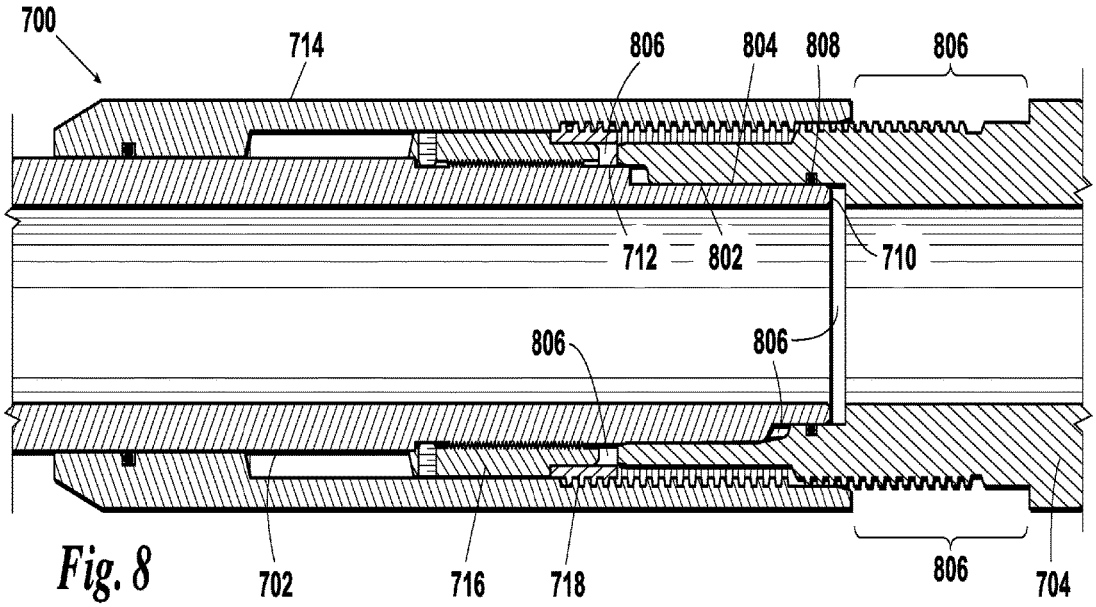
FIG. 8 is an illustration of a side cross-sectional view of a pair of joint sections at an intermediate engagement stage in accordance with an illustrative embodiment.

With reference now to FIG. 8, an illustration of a side cross-sectional view of a pair of joint sections at an intermediate engagement stage is depicted in accordance with an illustrative embodiment. In this illustrative example, connection section 700 is depicted with end 710 of upper joint section 702 inserted inside end 712 of lower joint section 704. Upper joint section 702 and lower joint section 704 have been mated together. As depicted, outer surface 802 of upper joint section 702 and inner surface 804 of lower joint section 704 have diameters of similar size. These diameters of similar size allow outer surface 802 of upper joint section 702 to connect with inner surface 804 of lower joint section 704. On the other hand, in this example, ends 710 and 712 do not contact surfaces of lower joint section 704 and upper joint section 702, respectively. Because ends 710 and 712 do not contact surfaces of lower joint section 704 and upper joint section 702, ends 710 and 712 do not bottom out and gaps 806 exist. Gaps 806 extend in the axial direction between upper joint section 702 and lower joint section 704.

In this example, connection section 700 also includes seal 808. Seal 808 is configured to prevent any leakage of fluids from the connection formed between outer surface 802 of upper joint section 702 and inner surface 804 of lower joint section 704. Additionally, filler may be inserted in gap 806 between end 710 of upper joint section 702 and end 712 of lower joint section 704. The filler may be made from a compressible material, such as, for example, without limitation, polymer or urethane material. For example, the filler may be a polymer ring. Fluids may flow through connection section 700 at certain pressures causing possible wear or erosion of components in connection 700. Inserting a filler in gap 806 in connection section 700 may reduce an amount of wear or erosion on end 710 of upper joint section 702 and end 712 of lower joint section 704.

Figure 9:
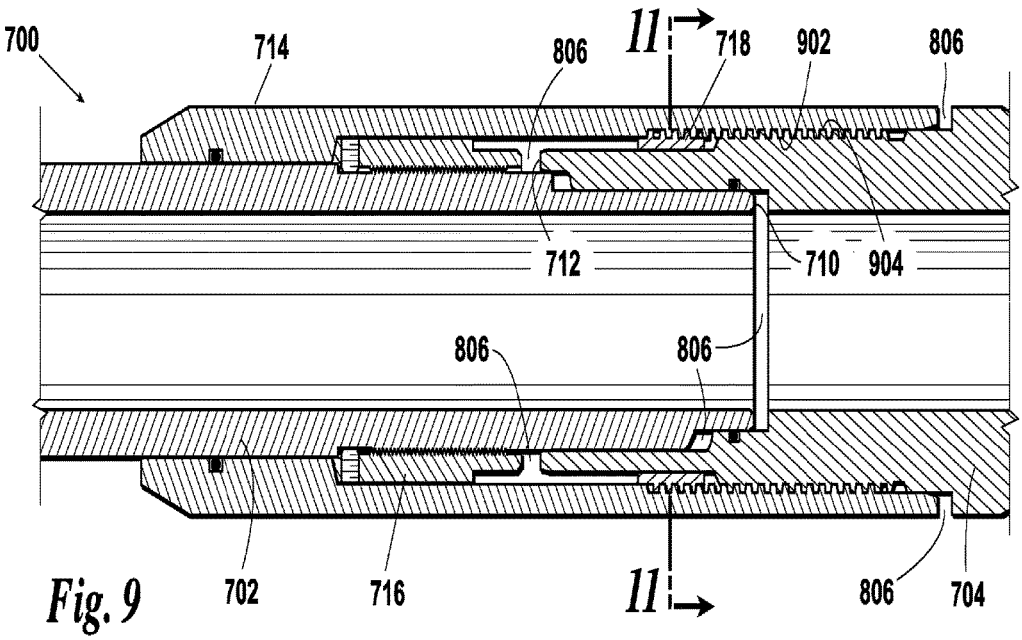
FIG. 9 is an illustration of a side cross-sectional view of a pair of joint sections at a fully engaged stage in accordance with an illustrative embodiment.

With reference now to FIG. 9, an illustration of a side cross-sectional view of a pair of joint sections at a fully engaged stage is depicted in accordance with an illustrative embodiment. In this illustrative example, connection section 700 is depicted at a fully engaged stage. Coupling 714 has been shifted in the axial direction around lower joint section 704. Threads 902 located on an inner surface of coupling 714 have been received by and rotated onto threads 904 located on an outer surface of lower joint section 704.

In this depicted embodiment, as coupling 714 is shifted axially towards lower joint section 704, a point is reached where load ring 716 begins to physically resist further axial movement of coupling 714 towards lower joint section 704. At this point, further tightening of coupling 714 on threads 904 begins to force upper joint section 702 and lower joint section 704 further together. Forcing upper joint section 702 and lower joint section 704 together may reduce the axial distance of gaps 806 between upper joint section 702 and lower joint section 704. However, in this example, ends 710 and 712 do not bottom out on surfaces of lower joint section 704 and upper joint section 702. Thus, gaps 806 extending in the axial direction between surfaces of upper joint section 702 and lower joint section 704 remain.

Figure 10:
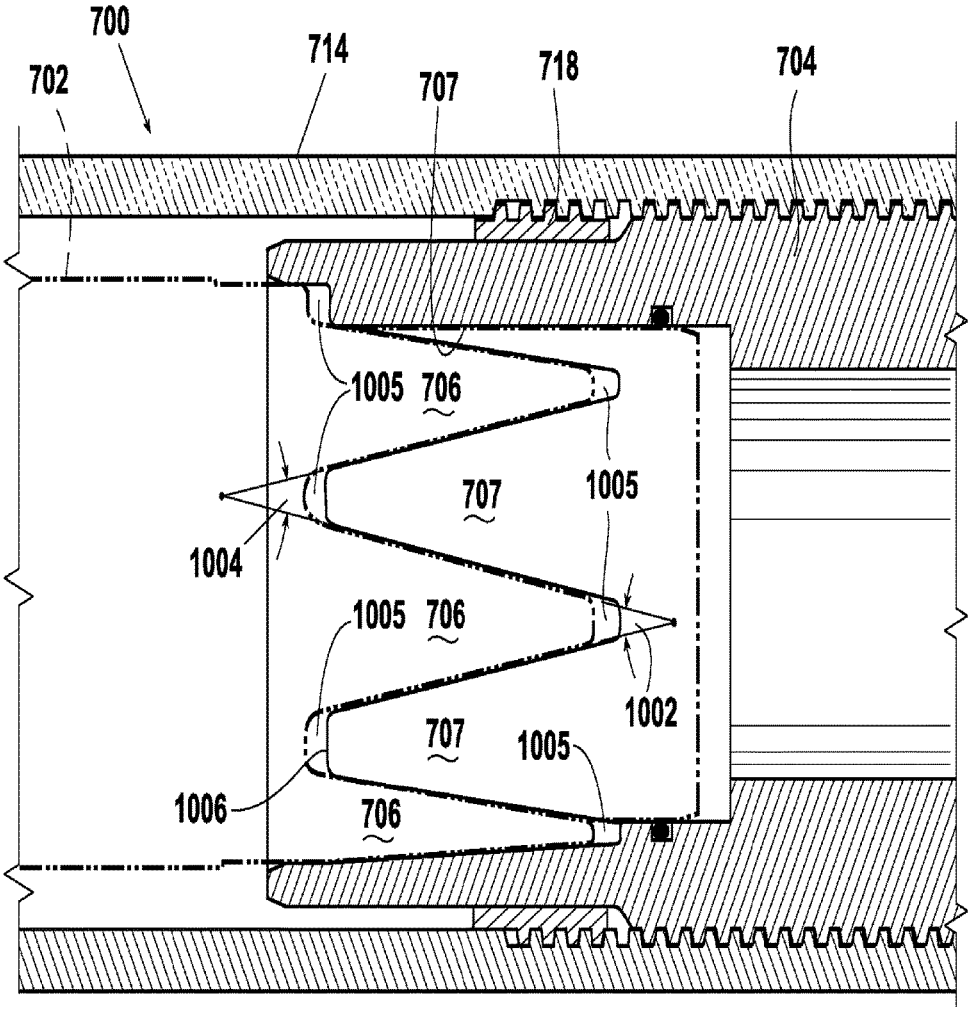
FIG. 10 is an illustration of an internal cross-sectional view of a pair of joint sections at a fully engaged stage in accordance with an illustrative embodiment.

With reference now to FIG. 10, an illustration of an internal cross-sectional view of a pair of joint sections at a fully engaged stage is depicted in accordance with an illustrative embodiment. In this illustrative example, connection section 700 at an engaged stage, such as illustrated in FIG. 8 and FIG. 9 for example, is seen from an internal view. This internal view provides greater detail regarding the position of plurality of splines 706 and plurality of splines 707.

As depicted, each spline of plurality of splines 706 is matched with a recessed area, such as one of recessed areas 512 in FIG. 5, located between adjacent splines of plurality of splines 707. Likewise, each spline of plurality of splines 707 is matched with a recessed area, such as one of recessed areas 420 in FIG. 4, located between adjacent splines of plurality of splines 706. In this example, the degree of spline flank angle 1002 is substantially equal to the degree of spline flank angle 1004. Because the degree of spline flank angle 1002 is substantially equal to the degree of spline flank angle 1004, each flank of the splines of plurality of splines 706 will come in contact with and seat on an opposing flank of a spline in of plurality of splines 707. Tightening of coupling 714 forces plurality of splines 706 between and towards plurality of splines 707. In this example, plurality of splines 706 and 707 also do not bottom out on opposing surfaces of upper joint section 702 and lower joint section 704. Thus, gaps 1005 are formed between tips 1006 of each of plurality of splines 706 and 707 and portions of the flanks of opposing splines. In this example, gaps 1005 may have a length that ranges from about 3/32 of an inch to about 9/32 of an inch in the axial direction. However, in other examples the length of gaps 1005 may be increased or decreased based upon a tightening and/or gap size considerations.

In this depicted embodiment, tightening of coupling 714 forces plurality of splines 706 between and towards plurality of splines 707. Preload in the connection caused by tightening of coupling 714 is generated from the mechanical advantage created by the wedge shape of the flanks of each of each of plurality of splines 706 and 707. As used herein, preload, when referring to a joint connection, refers to the force in a tightened joint connection prior to using the joint connection for its primary function. Preload is a compressive force resulting from two or more surface pairs being forced together during the assembly of a connection. The surfaces in compression can be tightened by any mechanical forces up to the yield strength of the surfaces in contact.

Preload increases the connection stiffness of connection 700 between upper joint section 702 and lower joint section 704. Connection stiffness is the resistance of a connection section to deflecting when external loads are applied to the pipe string. Preload in a connection allows the connection section between pipe joints to respond to forces as if the connection is a continuous section of pipe, because the connection section does not deflect. In this example, preload is applied to connection section 700 as upper joint section 702 and lower joint section 704 are forced together in the axial direction. Additionally, this preload is applied to surfaces of flanks of opposing splines. As gaps 1005 exist, the splines in connection section 700 have not bottomed out. Thus, additional tightening of coupling 714 increases an amount of preload in both the axial and circumferential directions for connection section 700.

In this illustrated embodiment, the angle selected for spline flank angle 1002 and 1004 has a value of about 18 degrees. However, in other advantageous embodiments spline flank angle 1002 and 1004 may be selected from a range between an angle having a value of about 10 degrees and an angle having a value of about 50 degrees. One of ordinary skill in the art would understand that as a spline flank angle approaches 90 degrees the mechanical advantage between opposing splines is reduced. Correspondingly, as a spline flank angle approaches zero degrees, disassembly of the joint sections may become more difficult once forces have been applied to the connection.

The tapered shape of plurality of splines 706 and 707 supplies a number of advantages to connection section 700. First, the tip of each of the splines is narrower than the base of the spline. The narrower tip fits within the larger recessed areas between the splines at an initial engagement stage, such as depicted in FIG. 7, for example. At such an initial engagement stage, a clearance exits between the narrower tip of the splines and the larger recessed areas. The clearance allows the splines to intermesh without the need for precise alignment at the initial engagement stage. Second, the area of contact between the flanks of the opposing splines allows torque to be transferred between upper joint section 702 and lower joint section 704. Transfer of torque between the flanks allows pipes connected by connection section 700 to be rotated either to the right or to the left without becoming disconnected. Further, as plurality of splines 706 are forced between and towards plurality of splines 707, the splines are wedged together. Wedging plurality of splines 706 and plurality of splines 707 together reduces possible radial gaps, such as joint slop for example, that may exist between flanks of opposing splines. Joint slop in a connection section may be any undesired gaps and/or lack of connection between surfaces of opposing joint sections. Wedging plurality of splines 706 and plurality of splines 707 together also forms a strong connection between upper joint section 702 and lower joint section 704. For example, the connection may be capable of withstanding levels of torque of about 15% or greater than the base pipe and about 70% or greater than connections used in current drilling applications.

Another advantage which may be attributable to the tapered shape of plurality of splines 706 and 707 is a reduction in the demand for machine tolerances. For example, irregularities may exist in one of more of the splines. One of the flanks of a spline may not be completely planar or the spline flank angle for one of the splines may not be formed to the exact degree desired. As the opposing splines are wedged together, the forces exerted on the splines adjacent to the spline having an irregularity may cause the irregular spline to deform. This deformation of the irregularity as the splines are wedged together may reduce problems caused by the irregularities.

The illustration of connection section 700 in FIG. 10 is not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of splines may be used. In other examples, splines may be any number of different sizes. Further, different illustrative embodiments may include splines having any number of different spline flank angles including angles beyond any previously discussed ranges. Still further, the spline flanks may be curved. For example, the spline flanks may have a slope that may be approximated by a parabolic curve. The spline flank angle may be formed by lines that are tangential to points on each flank in the pair.

Figure 11:
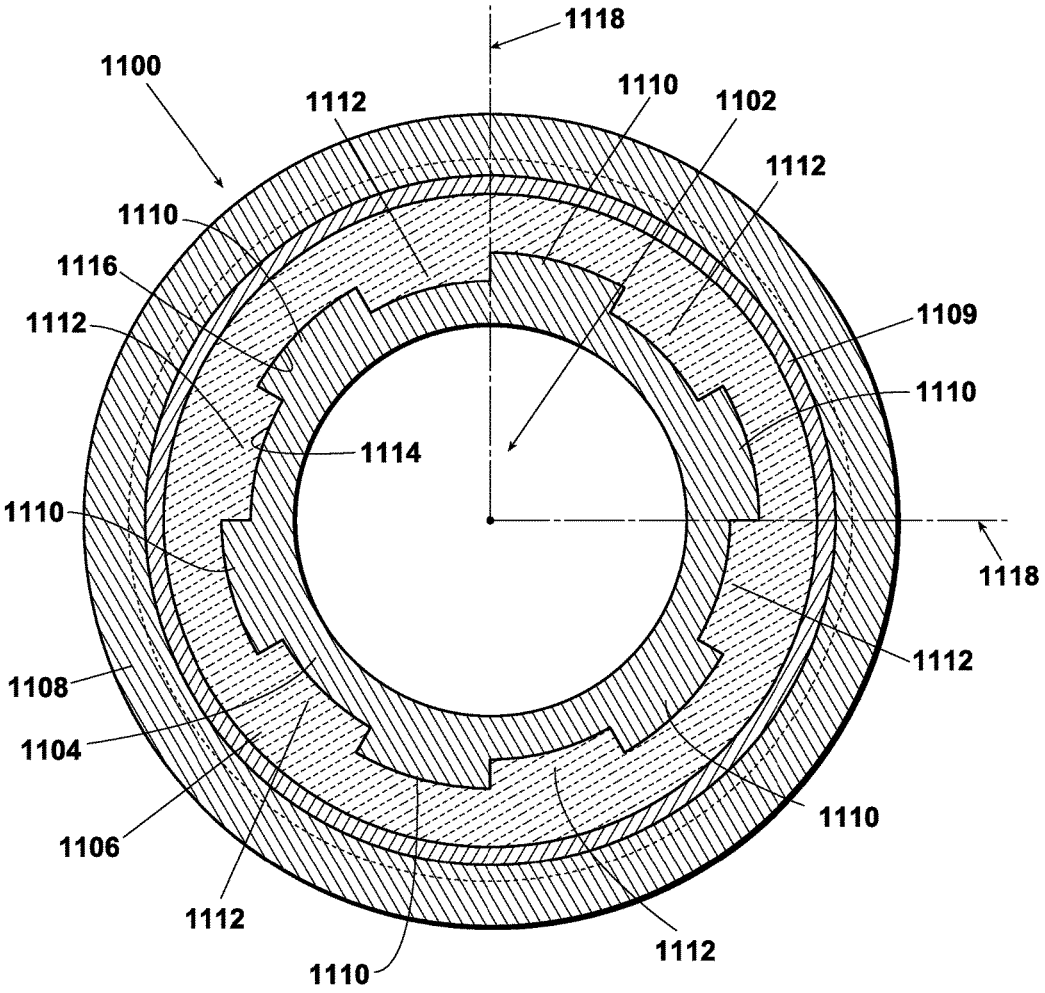
FIG. 11 is an illustration of a cross-sectional center view of a connection section at an engaged stage in accordance with an illustrative embodiment.

With reference now to FIG. 11, an illustration of a cross-sectional center view of a connection section at an engaged stage is depicted in accordance with an illustrative embodiment. In this illustrative example, connection section 1100 is seen from center view 1102. Connection section 1100 is an illustration of an example of one embodiment of connection section 700 in FIG. 7. Connection section 1100 includes male joint section 1104, female joint section 1106, coupling 1108, and retainer ring 1109. Male joint section 1104 includes plurality of splines 1110. Female joint section 1106 includes plurality of splines 1112. As can be seen, substantially no circumferential gaps occur between plurality of splines 1110 and 1112 because connection section 1100 is engaged.

In this illustrative embodiment, external forces applied to connection section 1100 are resisted by the connection stiffness of male joint section 1104 and female joint section 1106. Additionally, if torque were applied to connection section 1100, hoop stress and hoop tension would be experienced in connection section 1100. Hoop stress, in connection section 1100, is the resistance in male joint section 1104 that arrests retraction and the resistance in female joint section 1106 that arrests swelling as the two joint sections are compressed and/or rotated against each other. Hoop tension in connection section 1100 is the resisting force in the female joint section 1106 wall that provides support and counteracts the hoop stress in the male joint section 1104. For example, the thickness of inner wall 1114 of male joint section 1104 provides support for plurality of splines 1110. Support for plurality of splines 1110 provided by the thickness of inner wall 1114 of male joint section 1104 reduces the tendency for plurality of splines 1110 to retract. Inner wall 1114 also provides an area of support to reduce the exposure of plurality of splines 1110. The area of support provided by inner wall 1114 increases an amount of applied force that plurality of splines 1110 may withstand. In a similar manner, the thickness of outer wall 1116 of female joint section 1106 provides support for plurality of splines 1112. Support for plurality of splines 1112 provided by the thickness of outer wall 1116 of female joint section 1106 reduces the tendency for plurality of splines 1112 to expand. Outer wall 1116 also provides an area of support to reduce the exposure of plurality of splines 1112. The area of support provided by outer wall 1116 increases an amount of applied force that plurality of splines 1112 may withstand.

In addition, inner wall 1114 provides support in the area between the each spline in plurality of splines 1110. The support provided by inner wall 1114 reduces any tendency for splines of plurality of splines 1110 to shear inwardly. Similarly, outer wall 1116 provides support in the area between each spline in plurality of splines 1112. The support provided by outer wall 1116 reduces any tendency for splines of plurality of splines 1112 to shear outwardly. Thus, the cylindrical shape of inner wall 1114 and outer wall 1116 cause axial and torsional forces to be distributed evenly across plurality of splines 1110 and 1112 in connection section 1100. As torque is applied to one joint section, the torque is transferred to the other joint section through the plurality of splines 1110 and 1112 which are supported by the hoop stiffness caused by the cylindrically adjoined flanks. Thus, the overall torsional strength of the connection section 1100 is increased. As used herein, torsional strength, when referring to a connection section, means the amount of torsional forces the connection may withstand before the components of the connection section yield.

As depicted, both plurality of splines 1110 and 1112 have similar flank face angles 1118. In this illustrative embodiment, the angle of flank face angle 1118 is approximately 0 degrees. In this example, flank face angles 1118 are determined relative to the axis of the cylinder of connection section 1100. Flank face angles 1118 are an angle between a first line and a second line. The first line is perpendicular to the axis and intersects the spline flank at a point along the radial midpoint of the flank face. The second line is a line that is tangential to the point along the radial midpoint of the flank face that intersects with the first line. As depicted in FIG. 11 these two lines are substantially the same and thus the angle is approximately 0 degrees.

However, flank face angles 1118 may vary as the cross section of connection 1100 is shifted axially. For example, near the bases of splines in plurality of splines 1110 the flank face angle may be different than the flank face angle near the bases of splines in plurality of splines 1112. As depicted, in FIG. 11 flank face angles 1118 are zero degrees. The illustration of connection section 1100 in FIG. 11 may be at an axial midpoint of connection section 1100. The axial midpoint being the approximate midpoint between the bases of opposing splines in plurality of splines 1110 and 1112. As a cross-sectional view of connection section 1100 is shifted axially flank face angles 1118 may increase or decrease. Thus, flank face angles 1118 may vary in connection section 1100. Additionally, the flank face angle at a point on flanks in plurality of splines 1110 may be different than the flank face angle at a point on flanks in plurality of splines 1112.

Overall, flank face angle 1118 may be selected from a range between an angle having a value of about negative 30 degrees and an angle having a value of about 30 degrees. Additionally, flank face angle 1118 may vary in connection section 1100 from a range between an angle having a value of about negative 30 degrees and an angle having a value of about 30 degrees. Persons skilled in the art recognize and take note that an angle approaching 90 degrees may cause male joint section 1104 and female joint section 1106 to slip rotationally as torque load increases 1100. Persons skilled in the art recognize and take note that an angle approaching negative 30 degrees may cause the materials of the joint section to yield in response to certain levels of torque or other forces applied to connection section 1100.

The illustration of connection section 1100 in FIG. 11 is not meant to imply physical or architectural limitations to the manner in which different illustrative embodiments may be implemented. Other components may be added or substituted for the illustrated components. Some components may be unnecessary in some illustrative embodiments. For example, in different illustrative embodiments any number of splines may be used. In other examples, splines may be any number of different sizes. Further, different illustrative embodiments may include splines having any number of different flank face angles including angles beyond any previously discussed ranges. Moreover, different illustrative embodiments may combine splines with different flank face angles. Still further, the faces of flanks of splines in plurality of splines 1110 and 1112 may be curved.

Figure 12:
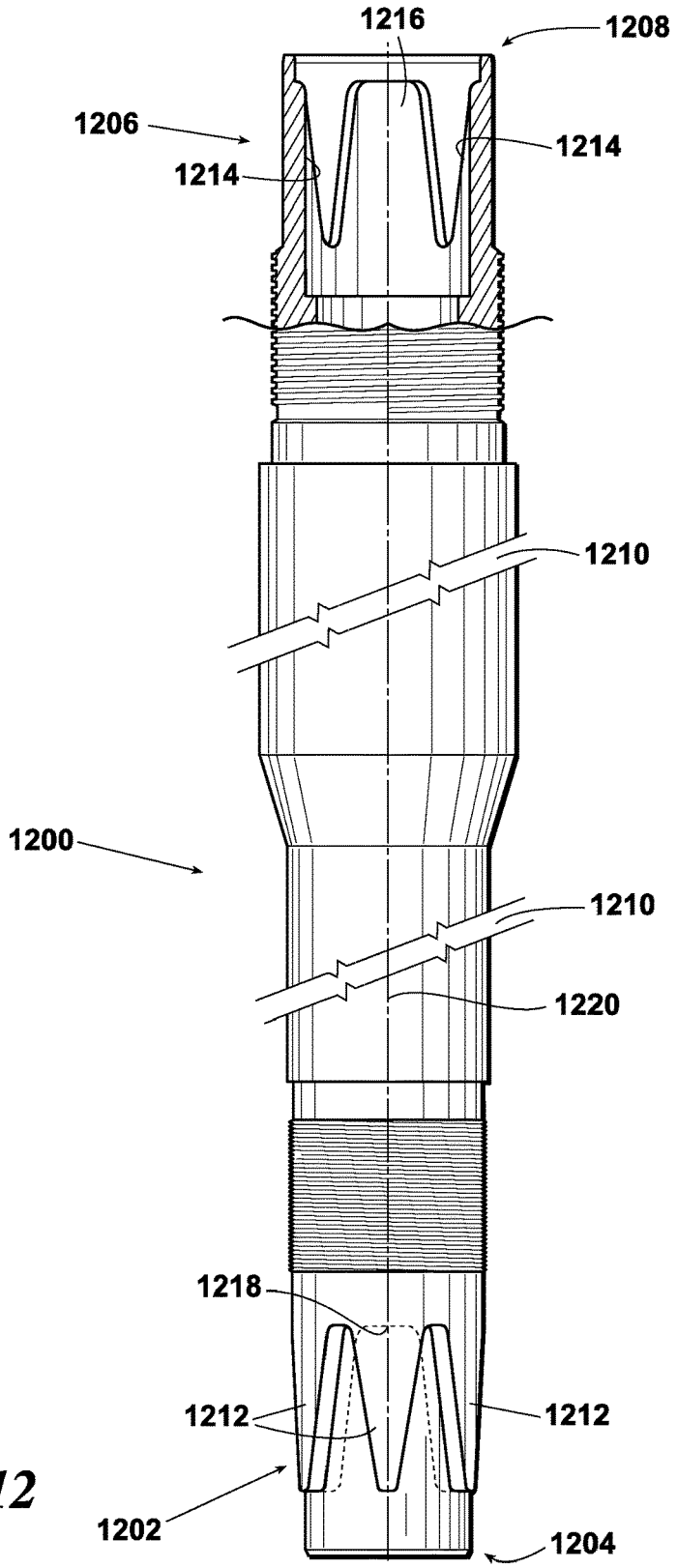
FIG. 12 is an illustration of a front view of a length of pipe having an orientation in accordance with an illustrative embodiment.

With reference now to FIG. 12, an illustration of a front view of a length of pipe having an orientation is depicted in accordance with an illustrative embodiment. In this illustrative example, pipe 1200 has first joint section 1202 at first end 1204 and second joint section 1206 at second end 1208. In this example, first joint section 1202 may be a male joint section, such as first joint section 302 in FIG. 3, and second joint section 1204 may be a female joint section, such as second joint section 304 in FIG. 3. Abbreviations 1210 are provided for illustrative purposes. Abbreviations 1210 allow greater detail of first joint section 1202 and second joint section 1206 to be seen on pipe 1200. Accordingly, pipe 1200 may not be illustrated to scale and may be longer than depicted.

In this illustrative embodiment, first joint section 1202 has plurality of splines 1212, while second joint section 1204 has plurality of splines 1214. Plurality of splines 1214 includes at least one spline, spline 1216, that is a different size than other splines in plurality of splines 1214. On the other end of pipe 1200, recessed area 1218 between splines in plurality of splines 1212 is larger than other recessed areas between splines in plurality of splines 1212. As depicted, both spline 1216 and recessed area 1218 are substantially centered on scribe line 1220. Scribe line 1220 is a reference line that extends from first end 1204 to second end 1208 on pipe 1200. In this example, centering both spline 1216 and recessed area 1218 along scribe line 1220 provides a particular orientation for pipe 1200.

In this illustrated embodiment, spline 1216 is larger than other splines in plurality of splines 1214. However, in other embodiments, splines 1216 may be smaller than other splines in plurality of splines 1214. In another example, splines 1216 may be tapered at a different angle than other splines in plurality of splines 1214. Still further, the different spline may be a part of one first joint section 1202 and any number of different sized splines may be used.

Figure 13:
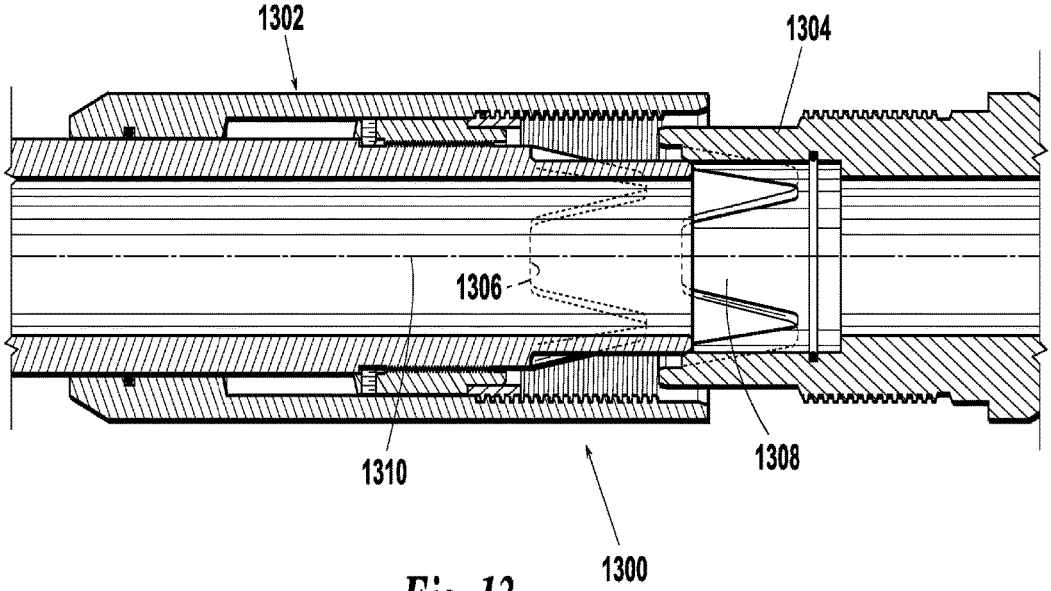
FIG. 13 is an illustration of a pair of joint sections having an orientation at an initial engagement stage in accordance with an illustrative embodiment.

With reference now to FIG. 13, an illustration of a pair of joint sections having an orientation at an initial engagement stage is depicted in accordance with an illustrative embodiment. In this illustrative example, connection section 1300 is shown at an initial engagement stage similar to connection section 700 in FIG. 7, for example. In this example, connection section 1300 uses pipes that maintain a particular orientation, such as pipe 1200 in FIG. 12. Connection section 1300 includes upper joint section 1302 and lower joint section 1304. Upper joint section 1302 includes recessed area 1306 similar to recessed area 1218 in FIG. 12. Lower joint section 1304 includes spline 1308 similar to spline 1216 in FIG. 12.

Connection section 1300 is configured such that spline 1308 may only be fit into and be received by recessed area 1306 when upper joint section 1302 and lower joint section 1304 are fully engaged. Configuring connection section 1300 such that spline 1308 may only be fit into and be received by recessed area 1306 when upper joint section 1302 and lower joint section 1304 are fully engaged allows connection section 1300 to maintain a particular orientation as illustrated by scribe line 1310. Further, maintaining this particular orientation of connection section 1300 may allow an entire string of drill pipe to maintain a selected and particular orientation. Additional methods and apparatuses for maintaining orientation of pipes are disclosed in U.S. Pat. No. 5,950,744 entitled "Method and Apparatus for Aligning Drill Pipe and Tubing," incorporated herein by reference.

Figure 14:
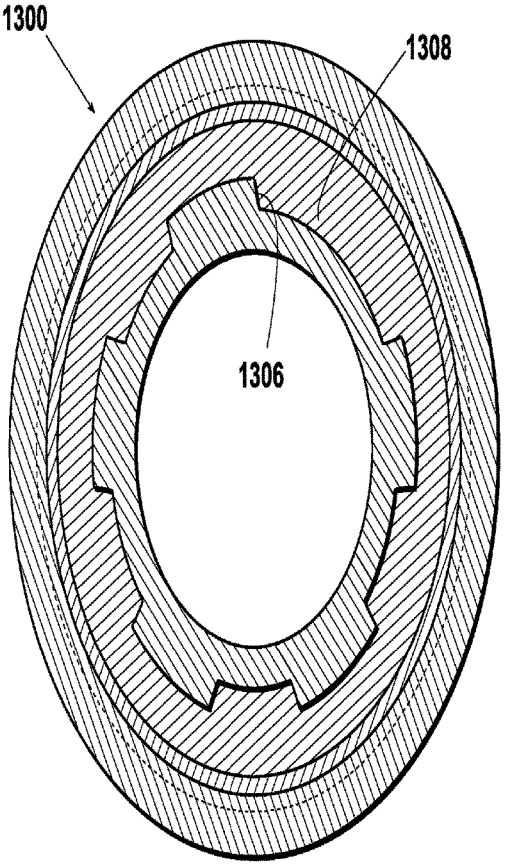
FIG. 14 is an illustration of a center view of a connection section having a particular orientation in accordance with an illustrative embodiment.

With reference now to FIG. 14, an illustration of a center view of a connection section having a particular orientation is depicted in accordance with an illustrative embodiment. In this depicted example, connection section 1300 is seen at a fully engaged stage. As illustrated, spline 1308 fits within and is received by recessed area 1306. Spline 1308 is larger than other splines and, thus, a particular orientation may be selected and maintained.

Figure 15:
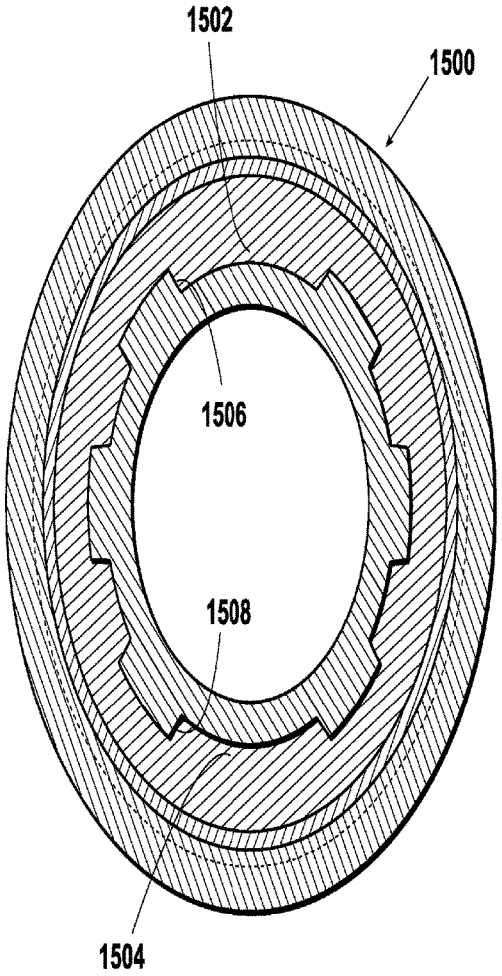
FIG. 15 is an illustration of a center view of a connection section having two particular orientations in accordance with an illustrative embodiment.

With reference now to FIG. 15, an illustration of a center view of a connection section having two particular orientations is depicted in accordance with an illustrative embodiment. In this depicted example, connection section 1500 is similar to connection section 1300 in FIG. 13. However, spline 1502 and spline 1504 are similar in size. Spline 1502 and spline 1504 may be received by either of recessed area 1506 or recessed area 1508. Thus, two particular orientations of connection section 1500 may be selected and maintained. In other embodiments, any number of orientations may be achieved.

Figure 16:
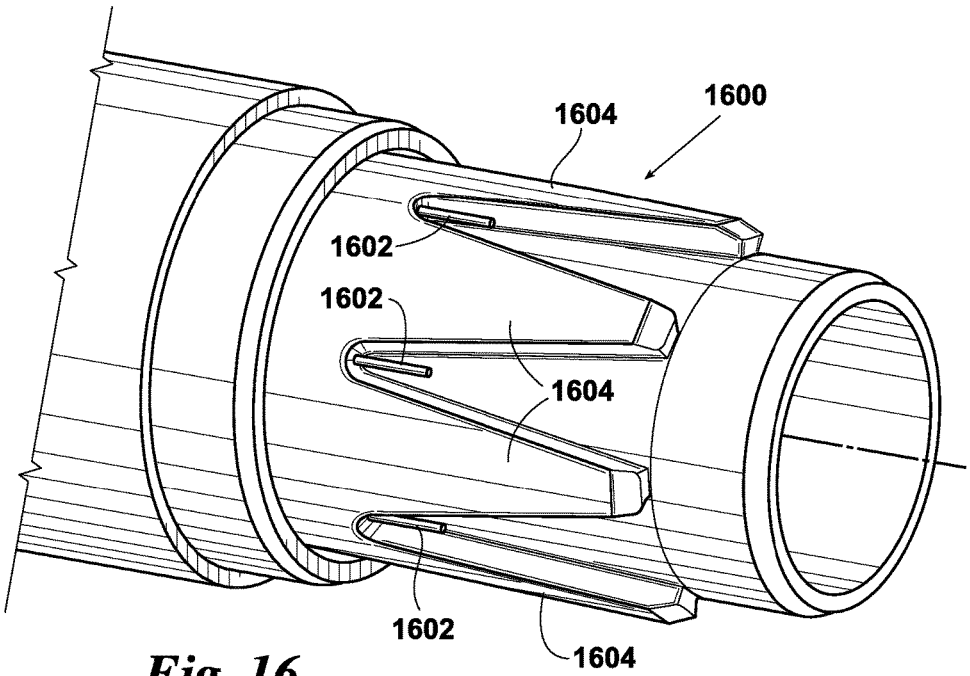
FIG. 16 is an illustration of a male joint section having wiring in accordance with an illustrative embodiment.

With reference now to FIG. 16, an illustration of a male joint section having wiring is depicted in accordance with an illustrative embodiment. In this illustrative example, male joint section 1600 includes electrical wires 1602 and plurality of splines 1604. Male joint section 1600 may be an example of one embodiment of first joint section 302 in FIG. 4 including electrical wiring. As depicted, electrical wires 1602 are positioned between bases of adjacent splines in plurality of splines 1604.

Figure 17:
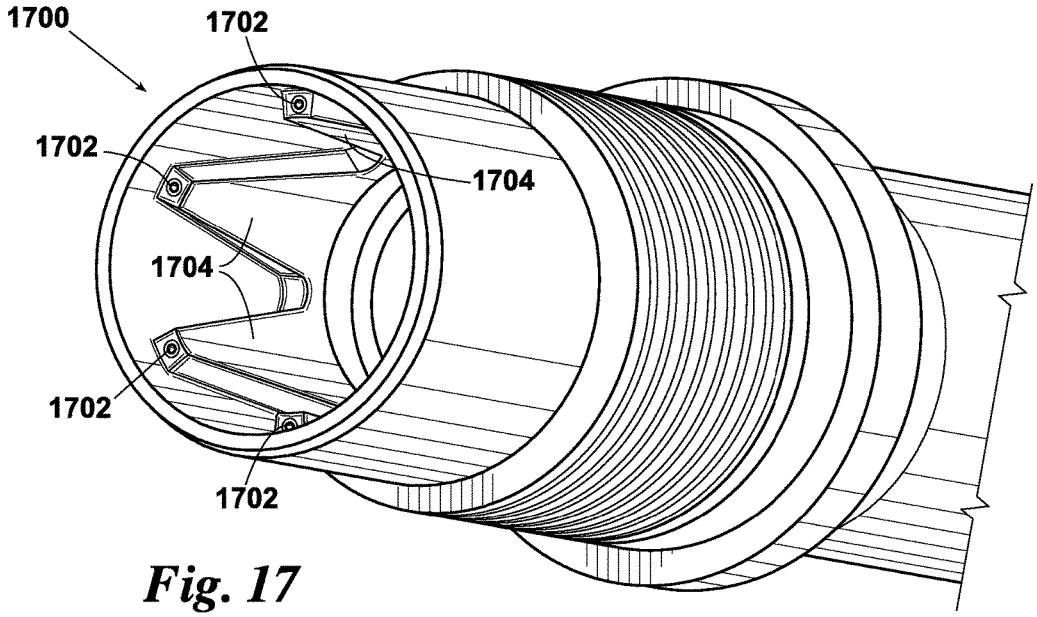
FIG. 17 is an illustration of a female joint section having wiring in accordance with an illustrative embodiment.

With reference now to FIG. 17, an illustration of a female joint section having wiring is depicted in accordance with an illustrative embodiment. In this illustrative example, female joint section 1700 includes electrical contacts 1702 and plurality of splines 1704. Female joint section 1700 may be an example of one embodiment of second joint section 304 in FIG. 5 including electrical contacts. As depicted, electrical contacts 1702 are positioned at the tips of splines in plurality of splines 1704. Female joint section 1700 may be joined with a male joint section, such as male joint section 1600 in FIG. 16, such as described in FIGS. 7-9 above, for example. In this embodiment, electrical contacts 1702 are configured to receive electrical wires, such as electrical wires 1602 in FIG. 16, as female joint section 1700 is joined with male joint section 1600 in FIG. 16. Thus, electrical wiring may be maintained through a connection of two pipes and/or as entire string of connected pipes. Additional methods and systems for including wiring in pipes are disclosed in U.S. Pat. No. 7,226,090 B2 entitled "Rod and Tubing Joint of Multiple Orientations Containing Electrical Wiring," incorporated herein by reference.

The illustrations of electrical wiring and electrical connections FIGS. 16-17 are not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of electrical wiring and electrical contacts may be used. Electrical wiring and/or electrical contacts may be inserted into any different configuration of male and/or female splines. Additionally, electrical wiring and contacts may be inserted into the walls of the pipes themselves.

Figure 18:
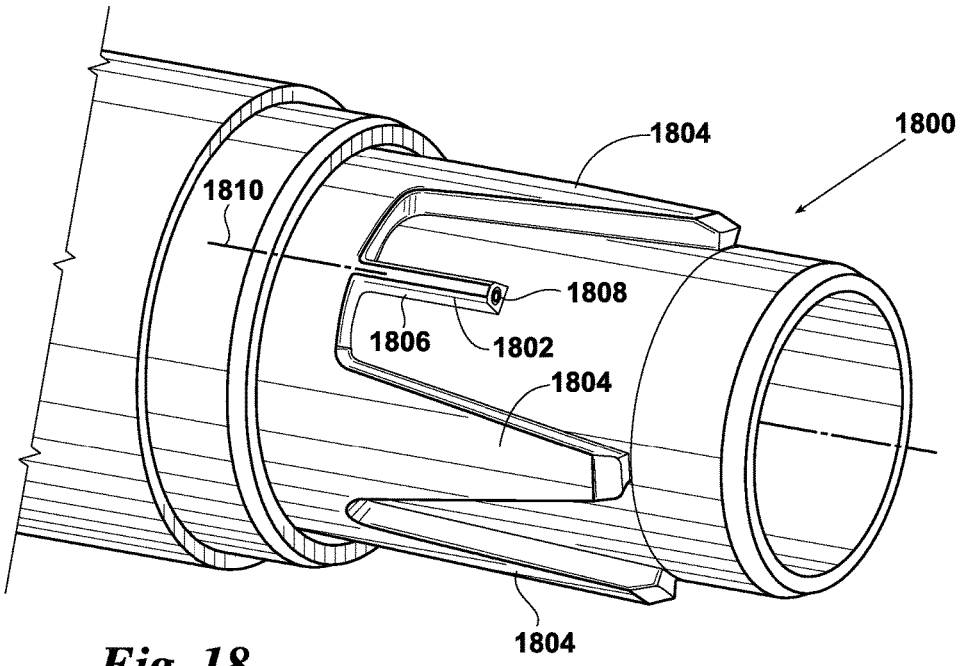
FIG. 18 is an illustration of a male joint section having wiring in accordance with an illustrative embodiment.

With reference now to FIG. 18, an illustration of a male joint section having wiring is depicted in accordance with an illustrative embodiment. In this illustrative example, male joint section 1800 includes spline 1802 and plurality of tapered splines 1804. Male joint section 1800 may be another example of an embodiment of first joint section 302 in FIG. 4 including a spline for electrical connections. Spline 1802 has flanks 1806 that are substantially parallel. Spline 1802 further includes electrical contact 1808 located at the tip of spline 1802. In this example, spline 1802 and electrical contact are substantially centered on scribe line 1810. Scribe line 1810 may be used to maintain a particular orientation for pipe connections such as described with respect to FIGS. 12-15 above, for example.

Figure 19:
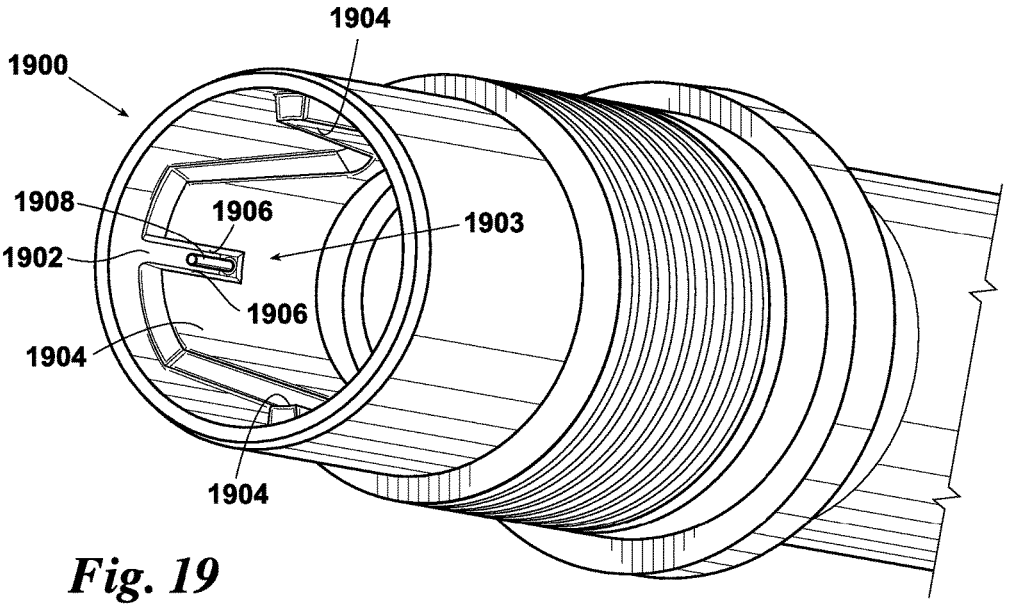
FIG. 19 is an illustration of a female joint section having wiring in accordance with an illustrative embodiment.

With reference now to FIG. 19, an illustration of a female joint section having wiring is depicted in accordance with an illustrative embodiment. In this illustrative example, female joint section 1900 includes recessed area 1902, located inside of orientation spline 1903, and plurality of tapered splines 1904, which includes orientation spline 1903. Female joint section 1900 may be another example of an embodiment of second joint section 304 in FIG. 5 including a recessed area for electrical connections. Recessed area 1902 has sides 1906 that are substantially parallel. Recessed area 1902 further includes electrical wire 1908 extending from the base of recessed area 1902.

Female joint section 1900 may be joined with a male joint section, such as male joint section 1800 in FIG. 18. These sections may be joined as described in FIGS. 7-9 above, for example. Recessed area 1902 is adapted to receive spline 1802 in FIG. 18 as female joint section 1900 is joined with male joint section 1800 in FIG. 18. A substantially parallel configuration of recessed area 1902 and spline 1802 in FIG. 18 allows for electrical wire 1908 to be guided into electrical contacts 1808 in FIG. 18. Guiding of electrical wire 1908 by the substantially parallel configuration may allow for a connection between electrical contacts 1808 in FIGS. 18 and 1908 without a need to manually align electrical connectors 1808 in FIGS. 18 and 1908 themselves as male joint section 1800 in FIG. 18 and female joint section 1900 are joined together.

While spline 1802 in FIG. 18 and recessed area 1902 may aid in the connection of electrical wiring, spline 1802 in FIG. 18 may not be tapered similar to plurality of tapered splines 1804 in FIG. 18. Thus, spline 1802 in FIG. 18 and recessed area 1902 may not provide the same advantages of torque transmission described above with respect to FIG. 11. However, positioning recessed area 1902 inside orientation spline 1903 reduces any negative impact using non-tapered splines for electrical connections may have.

The illustrations of electrical connections and splines having substantially parallel sides in FIGS. 18-19 are not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of electrical wiring and electrical contacts may be used. Electrical wiring and/or electrical contacts may be inserted into any different configuration of male and/or female splines. Additionally, any number of splines having substantially parallel flanks may be located in or between any number of different splines.

The description of the different embodiments of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

What is claimed is:

1. An apparatus comprising:

a first number of splines located near a first end of a first joint section, the first number of splines disposed on a circumferential outer surface of the first joint section, and extending in a first axial direction towards the first end and outwardly in a first radial direction from the circumferential outer surface, each of the first number of splines having a base, a tip, and a pair of flanks extending from the base to the tip, wherein the pair of flanks forms an acute angle, wherein the first number of splines have first root radii at first interfaces between the first number of splines and the circumferential outer surface, and wherein a number of first edges of the first number of splines have a first rounded off portion;

a second number of splines located near a second end of a second joint section, the second number of splines disposed on a circumferential inner surface of the second joint section and extending in a second axial direction towards the second end and inwardly in a second radial direction from the circumferential inner surface, each of the second number of splines having a base, a tip, and a pair of flanks extending from the base to the tip, wherein the pair of flanks forms an acute angle, wherein the second number of splines have second root radii at second interfaces between the second number of splines and the circumferential outer surface, and wherein a number of second edges of the second number of splines have a second rounded off portion;

wherein each of the first number of splines is configured to be received between adjacent pairs of splines in the second number of splines as the first end of the first joint section and the second end of the second joint section are joined together to form a connection between the first joint section and the second joint section, wherein a gap remains between each tip of each of the first number of splines and corresponding portions of the flanks of the second number of splines when the first joint section and the second joint section are fully connected;

a first orientation spline of the second number of splines having a size that is substantially different from other splines in the second number of splines, wherein the size of the first orientation spline is wider than the other splines in the second number of splines;

a first recessed area on the first joint section near the first end, the first recessed area positioned between a pair of splines of the first number of splines, the first recessed area adapted to receive the first orientation spline, wherein the first orientation spline and the first recessed area maintain a particular orientation for the connection of the first joint section and the second joint section;

wherein the first orientation spline includes a second recessed area comprised of spaced sides and a base that connects the spaced sides, the base being spaced from a second end of the second joint section;

wherein the first recessed area of the first joint section includes a second orientation spline that has spaced sides and a tip, the tip being spaced from the first end of the first joint section, the second orientation spline having a size that is substantially different from the first number of splines;

wherein the spaced sides of the second recessed area accommodate the spaced sides of the second orientation spline such that the tip of the second orientation spline is positioned adjacent to the base of the second recessed area when the first joint section and the second joint section are interconnected; and a third orientation spline of the second number of splines; and a third recessed area on the first joint section near the first end, the third recessed area positioned between a pair of splines of the second number of splines, the third recessed area adapted to receive the third orientation spline.

2. The apparatus of claim 1, wherein each first rounded off portion and each second rounded off portion reduce a sticking of the first number of splines and the second number of splines when the first joint section and the second joint section are separated after having been fully connected.

3. The apparatus of claim 1, wherein the spaced sides of the second orientation spline and the spaced sides of the second recess are tapered.

4. The apparatus of claim 1, wherein the spaced sides of the second orientation spline and the spaced sides of the second recess are substantially parallel.

5. The apparatus of claim 1, wherein the tip of the second orientation spline has an electrical contact, wherein the second recessed area accommodates an electrical wire that extends from the base and wherein the electrical wire is received within the electrical contact when the first joint section and the second joint section are interconnected.

6. An apparatus comprising:

a first number of splines located near a first end of a first joint section, the first number of splines extending in an axial direction of the first joint section, the first number of splines spanning a circumferential surface of the first joint section, each of the first number of splines having a base, a tip, and a pair of flanks extending from the base to the tip wherein the pair of flanks forms an acute angle;

a second number of splines located near a second end of a second joint section, the second number of splines extending in an axial direction of the second joint section, the second number of splines spanning a circumferential surface of the second joint section, each of the second number of splines having a base, a tip, and a pair of flanks extending from the base to the tip wherein the pair of flanks forms an acute angle;

wherein each of the first number of splines is configured to be received between adjacent pairs of splines in the second number of splines as the first end of the first joint section and the second end of the second joint section are joined together to form a connection between the first joint section and the second joint section;

a first orientation spline of the second number of splines having a size that is substantially different from other splines in the second number of splines wherein the size of the first orientation spline is a wider size from other splines in the second number of splines;

a first recessed area on the first joint section near the first end, the first recessed area positioned between a pair of splines of the second number of splines, the first recessed area adapted to receive the first orientation spline, wherein the first orientation spline and the first recessed area maintain a particular orientation for the connection of the first joint section and the second joint section;

wherein the first orientation spline includes a second recessed area comprised of spaced sides and a base that connects the spaced sides, the base being spaced from a second end of the second joint section;

wherein the first recessed area of the first joint section includes a second orientation spline that has spaced sides and a tip, the tip being spaced from the first end of the first joint section, the second orientation spline having a size that is substantially different from the first number of splines;

wherein the spaced sides of the second recessed area accommodate the spaced sides of the second orientation spline such that the tip of the second orientation spline is positioned adjacent to the base of the second recessed area when the first joint section and the second joint section are interconnected;

a third orientation spline of the second number of splines;

a third recessed area on the first joint section near the first end, the third recessed area positioned between a pair of splines of the second number of splines, the third recessed area adapted to receive the third orientation spline; and wherein the tip of the second orientation spline has an electrical contact, wherein the second recessed area accommodates an electrical wire that extends from the base, and wherein the electrical wire is received within the electrical contact when the first joint section and the second joint section are interconnected.

7. The apparatus of claim 6, wherein the electrical contact is substantially centered on a scribe line that is generally parallel with the longitudinal axis of the first joint section.

8. The apparatus of claim 6, wherein the spaced sides of the second orientation spline and the spaced sides of the second recess are tapered.

9. The apparatus of claim 6, wherein the spaced sides of the second orientation spline and the spaced sides of the second recess are substantially parallel.

* * * * *